US010311673B2

(12) United States Patent
Helgesen et al.

(10) Patent No.: US 10,311,673 B2
(45) Date of Patent: *Jun. 4, 2019

(54) WAGER RECOGNITION SYSTEM HAVING AMBIENT LIGHT SENSOR AND RELATED METHOD

(71) Applicant: Bally Gaming, Inc., Las Vegas, NV (US)

(72) Inventors: James P. Helgesen, Eden Prairie, MN (US); Troy D. Nelson, Big Lake, MN (US); Vladislav Zvercov, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/382,311

(22) Filed: Dec. 16, 2016

(65) Prior Publication Data

US 2017/0098343 A1 Apr. 6, 2017

Related U.S. Application Data

(63) Continuation of application No. 14/260,042, filed on Apr. 23, 2014, now Pat. No. 9,536,389, which is a (Continued)

(51) Int. Cl.
*G07F 17/32* (2006.01)

(52) U.S. Cl.
CPC ..... *G07F 17/3248* (2013.01); *G07F 17/322* (2013.01); *G07F 17/3211* (2013.01); *G07F 17/3225* (2013.01); *G07F 17/3251* (2013.01)

(58) Field of Classification Search
CPC ..... G07F 17/3248; G07F 17/3211; G07F 17/3225; G07F 17/322; G07F 17/3251
See application file for complete search history.

(56) References Cited

U.S. PATENT DOCUMENTS 3,939,953 A 2/1976 Miyazawa
4,305,586 A 12/1981 Richards
(Continued)

FOREIGN PATENT DOCUMENTS

CA 2195329 A1 2/1997
CA 2243738 A1 1/2000
(Continued)

OTHER PUBLICATIONS

Analog Current Output Type Ambient Light Sensor IC, BH1600FVC, Rohm Semiconductor, <<www.rohm.com>> 2012, pp. 1-8.*
(Continued)

*Primary Examiner* — Werner G Garner
(74) *Attorney, Agent, or Firm* — TraskBritt

(57) ABSTRACT

A gaming table apparatus has a gaming table with a gaming table support surface. A token sensor assembly includes a container having a height and side walls that define an inside and outside perimeter of the container, and a top surface and bottom surface, a translucent cover disposed on the top surface of the side walls, a circuit board secured to the inside perimeter of the container, a plurality of lights disposed on a top side of the circuit board, and a passive ambient light sensor disposed on the top side of the circuit board. The passive ambient light sensor and the translucent cover may operate within predetermined wavelength ranges for receiving and passing light, respectively. A condition of the passive ambient light sensor may not be polled if the plurality of lights is emitting light.

17 Claims, 14 Drawing Sheets

Related U.S. Application Data continuation-in-part of application No. 12/946,814, filed on Nov. 15, 2010, now Pat. No. 9,142,084.

(56) References Cited

U.S. PATENT DOCUMENTS

| | | | |
|---|---|---|---|
| 4,488,431 | A | 12/1984 | Miga |
| 4,593,904 | A | 6/1986 | Graves |
| 4,651,997 | A | 3/1987 | Wood |
| 4,652,998 | A | 3/1987 | Koza et al. |
| 4,659,087 | A | 4/1987 | Shen et al. |
| 4,743,022 | A | 5/1988 | Wood |
| 4,756,531 | A | 7/1988 | DiRe et al. |
| 4,813,675 | A | 3/1989 | Greenwood |
| 4,836,546 | A | 6/1989 | DiRe et al. |
| 4,836,553 | A | 6/1989 | Suttle et al. |
| 4,837,728 | A | 6/1989 | Barrie et al. |
| 4,842,276 | A | 6/1989 | Darby |
| 4,861,041 | A | 8/1989 | Jones et al. |
| 4,882,473 | A | 11/1989 | Bergeron et al. |
| 4,906,005 | A | 3/1990 | Manabe |
| 4,948,134 | A | 8/1990 | Suttle et al. |
| 5,019,973 | A | 5/1991 | Wilcox et al. |
| 5,042,635 | A | 8/1991 | Bell |
| 5,042,818 | A | 8/1991 | Weingardt |
| 5,078,405 | A | 1/1992 | Jones et al. |
| 5,098,107 | A | 3/1992 | Boylan et al. |
| 5,112,060 | A | 5/1992 | Jones |
| 5,114,155 | A | 5/1992 | Tillery et al. |
| 5,116,055 | A | 5/1992 | Tracy |
| 5,167,413 | A | 12/1992 | Fulton |
| 5,174,579 | A | 12/1992 | Griffiths |
| 5,248,142 | A | 9/1993 | Breeding |
| 5,275,400 | A | 1/1994 | Weingardt et al. |
| 5,275,415 | A | 1/1994 | Wisted |
| 5,288,077 | A | 2/1994 | Jones |
| 5,288,081 | A | 2/1994 | Breeding |
| 5,356,140 | A | 10/1994 | Dabrowski et al. |
| 5,364,104 | A | 11/1994 | Jones et al. |
| 5,377,993 | A | 1/1995 | Josephs |
| 5,377,994 | A | 1/1995 | Jones |
| 5,382,025 | A | 1/1995 | Sklansky et al. |
| 5,390,934 | A | 2/1995 | Grassa |
| 5,393,067 | A | 2/1995 | Paulsen et al. |
| 5,417,430 | A | 5/1995 | Breeding |
| 5,472,194 | A | 12/1995 | Breeding et al. |
| 5,544,892 | A | 8/1996 | Breeding |
| 5,577,731 | A | 11/1996 | Jones |
| 5,586,936 | A | 12/1996 | Bennett et al. |
| 5,632,485 | A | 5/1997 | Woodland et al. |
| 5,636,843 | A | 6/1997 | Roberts |
| 5,649,705 | A | 7/1997 | String |
| 5,673,917 | A | 10/1997 | Vancura |
| 5,707,285 | A | 1/1998 | Place et al. |
| 5,732,950 | A | 3/1998 | Moody |
| 5,735,742 | A | 4/1998 | French |
| 5,743,800 | A | 4/1998 | Huard et al. |
| 5,791,989 | A | 8/1998 | Slinkman |
| 5,794,964 | A | 8/1998 | Jones et al. |
| 5,816,575 | A | 10/1998 | Keller |
| 5,836,583 | A | 11/1998 | Towers |
| 5,839,730 | A | 11/1998 | Pike |
| 5,851,011 | A | 12/1998 | Lott |
| 5,909,876 | A | 6/1999 | Brown |
| 5,911,626 | A | 6/1999 | McCrea, Jr. |
| 5,924,926 | A | 7/1999 | Brown |
| 5,984,308 | A | 11/1999 | Herrmann |
| 6,139,430 | A | 10/2000 | Huard et al. |
| 6,146,270 | A | 11/2000 | Huard et al. |
| 6,158,741 | A | 12/2000 | Koelling |
| 6,299,534 | B1 | 10/2001 | Breeding et al. |
| 6,325,375 | B1 | 12/2001 | Potter et al. |
| 6,346,044 | B1 | 2/2002 | McCrea, Jr. |
| 6,446,864 | B1 | 9/2002 | Kim et al. |
| 6,481,718 | B2 | 11/2002 | Koelling |
| 6,517,073 | B1 | 2/2003 | Vancura |
| 6,596,407 | B2 | 7/2003 | Nishimura et al. |
| 6,607,195 | B2 | 8/2003 | Vancura |
| 6,854,731 | B2 | 2/2005 | Saucier |
| 7,083,891 | B2 | 8/2006 | Shimomura et al. |
| 7,338,362 | B1 | 3/2008 | Gallagher |
| 7,367,884 | B2 | 5/2008 | Breeding et al. |
| 7,407,438 | B2 | 8/2008 | Schubert et al. |
| 7,462,444 | B2 | 12/2008 | Oka et al. |
| D594,912 | S | 6/2009 | Hall et al. |
| 7,593,544 | B2 | 9/2009 | Downs, III et al. |
| 7,645,489 | B2 | 1/2010 | Ozawa et al. |
| 7,677,565 | B2 | 3/2010 | Grauzer et al. |
| 7,717,427 | B2 | 5/2010 | Grauzer et al. |
| 7,749,316 | B2 | 7/2010 | Mizushima et al. |
| 7,764,836 | B2 | 7/2010 | Downs, III et al. |
| 7,766,332 | B2 | 8/2010 | Grauzer et al. |
| 7,769,232 | B2 | 8/2010 | Downs, III |
| 8,348,749 | B1 | 1/2013 | Ungaro et al. |
| 8,740,692 | B2 | 6/2014 | Yoseloff et al. |
| 2002/0045480 | A1 | 4/2002 | Soltys et al. |
| 2002/0089120 | A1 | 7/2002 | Miller |
| 2004/0009799 | A1* | 1/2004 | Breeding ..... A63F 3/00157 463/11 |
| 2004/0061288 | A1 | 4/2004 | Snow |
| 2004/0204240 | A1 | 10/2004 | Barney |
| 2005/0258597 | A1 | 11/2005 | Soltys et al. |
| 2007/0017983 | A1 | 1/2007 | Frank et al. |
| 2007/0111786 | A1 | 5/2007 | Snow |
| 2007/0246145 | A1 | 10/2007 | Feiertag |
| 2008/0125211 | A1 | 5/2008 | Plowman |
| 2008/0146344 | A1 | 6/2008 | Rowe et al. |
| 2008/0248849 | A1 | 10/2008 | Lutnick et al. |
| 2008/0303210 | A1 | 12/2008 | Grauzer et al. |
| 2009/0111573 | A1 | 4/2009 | Iddings |
| 2009/0121883 | A1 | 5/2009 | Knust |
| 2009/0253498 | A1 | 10/2009 | Wolf et al. |
| 2010/0093429 | A1 | 4/2010 | Mattice et al. |
| 2010/0105485 | A1 | 4/2010 | Kuhn |
| 2011/0115157 | A1 | 5/2011 | Filo et al. |
| 2011/0309578 | A1 | 12/2011 | Lambert et al. |
| 2012/0122559 | A1* | 5/2012 | Kelly ..... G07F 17/322 463/25 |
| 2013/0109455 | A1 | 5/2013 | Grauzer et al. |
| 2013/0116032 | A1 | 5/2013 | Lutnick |
| 2014/0087805 | A1 | 3/2014 | Snow |
| 2014/0087806 | A1 | 3/2014 | Snow |
| 2016/0093161 | A1 | 3/2016 | Yee |
| 2016/0180634 | A1 | 6/2016 | Montgomery |

FOREIGN PATENT DOCUMENTS

| | | | |
|---|---|---|---|
| CA | 2472735 | A1 | 1/2005 |
| CA | 2516025 | A1 | 3/2006 |
| DE | 4439502 | C1 | 9/1995 |
| EP | 0443420 | B1 | 1/1995 |
| EP | 0813075 | A1 | 12/1997 |
| WO | 2008028148 | A2 | 3/2008 |
| WO | 2008/061001 | A2 | 5/2008 |

OTHER PUBLICATIONS

Analog Current Output Type Ambient Light Sensor IC, BH 1603FVC, 2012, Rohm Semiconductors, <<https://www.rohm.com/datasheet/BH1603FVC/bh1603fvc-e>>.*

Canadian Office Action from Canadian Application No. 2,946,140, dated Aug. 23, 2017, 4 pages.

International Search Report from International Patent Application No. PCT/2015/027134, dated Jul. 20, 2015, 4 pages.

International Written Opinion from International Patent Application No. PCT/2015/027134, dated Jul. 20, 2015, 5 pages.

Australian Examination Report for Australian Application No. 2015249768, dated Apr. 6, 2017, 3 pages.

Korean Office Action for Korean Application No. 10-2016-7032079, dated Dec. 19, 2017, 9 pages with English translation.

European Examination Report from European Application No. 15721444.6, dated Dec. 6, 2017, 6 pages.

(56) References Cited

OTHER PUBLICATIONS

Korean Office Action for Korean Application No. 10-2016-7032079, dated Jun. 26, 2018, 5 pages with English translation.
Chinese Office Action and Search Report from Chinese Application No. 201580033286.6, dated Aug. 3, 2018, 10 pages.
Australian Examination Report for Australian Application No. 2017251763, dated Nov. 5, 2018, 5 pages.

* cited by examiner

402

WAGER RECOGNITION SYSTEM HAVING AMBIENT LIGHT SENSOR AND RELATED METHOD

CROSS-REFERENCE TO RELATED APPLICATIONS

This application is a continuation of U.S. patent application Ser. No. 14/260,042, filed Apr. 23, 2014, now U.S. Pat. No. 9,536,389, issued Jan. 3, 2017, which is a continuation-in-part of U.S. patent application Ser. No. 12/946,814, filed Nov. 15, 2010, now U.S. Pat. No. 9,142,084, issued Sep. 22, 2015, the disclosure of each of which is hereby incorporated herein in its entirety by reference.

TECHNICAL FIELD

The present disclosure relates to the field of table gaming, wagering methods and apparatuses on gaming tables, and automated recognition of wagers on gaming tables.

BACKGROUND

In casino table games, wagering was originally done (and in many circumstances is still done) exclusively by the physical placement of money, currency, coins, tokens, or chips on the gaming table, on a betting circle printed on a table surface and allowing the wager to remain on the gaming table until conclusion of the game and resolution of the wager(s). The placement of physical wagers on gaming tables allows for some players to attempt to commit fraud on casinos by the late placement of wagers, alteration of wagers, and particularly, the late placement of side bet wagers, bonus wagers, and jackpot wagers.

As the payouts for side bets, bonuses, and jackpots can reach levels of hundreds of thousands of dollars or more at gaming tables, the temptation to commit fraud at the gaming table increases. Similarly, the casino's need to prevent fraud increases in order to assure the wagering game is fair to all players. With the linkage of wagering game jackpots (e.g., different games) within a casino (or among different casinos), a uniform standard of control is needed that assures avoidance and prevention of cheating at all tables and at all facilities.

Numerous systems have been provided or disclosed for the automated recognition of wagers, including side bets, bonus wagers, and jackpot wagers. For example, in U.S. Pat. No. 5,794,964 (Jones), a sensor detects when a gaming token is dropped into a slot in the gaming table surface and a coin acceptor is mounted to detect the passage of a gaming token through the slot.

U.S. Pat. Nos. 5,544,892, 6,299,534 and 7,367,884 (Breeding) disclose an apparatus for detecting the presence of a gaming token. This apparatus has at least one predetermined location for receiving a gaming token on a gaming table. At each predetermined location for receiving a gaming token designated on the gaming table, a proximity sensor is mounted to the gaming table such that each proximity sensor is aligned with one predetermined location. A decoder is electrically connected to each proximity sensor for determining whether a gaming token is present at each predetermined location. When the presence of a gaming token is sensed by the decoder, the player's bet is registered by transmission of a signal indicating the sensed presence to a processor. Each sensor in these systems has a parallel connection to a processor (e.g., game processor or system processor) where the individual wagers are recorded and identified. In a preferred embodiment of these systems, there is a backlight under the predetermined location that lights up when a wager is made at that location, and remains lit when the processor identifies acceptance and recognition of the wager during each game or round of play at the gaming table.

The sensors in U.S. Pat. No. 7,367,884 are modulated light sensors mounted into a machined enclosure or flanged "can" with an upper flange, which in turn, are flush mounted into the gaming table surface. The sensor detects an object, or chip, placed on top of a lens above the sensor. When the light source in those sensors hits a "black spot" on the chip (a high optical density dark spot, such as black marking), the chip presence may not be sensed. A misread could also result from light reflecting off the inside of the sensor cover, or in some cases even ambient light "bleeding through" the cover to the receiver. Additionally, the sensor "can" structure required that a table top be retrofitted by drilling out holes in the table support surface to accommodate the "can." Furthermore, each individual sensor described in the '884 patent is directly connected to a gaming controller, which requires individual complicated wiring leading to a time consuming installation. Each token sensor assembly requires its own microcontroller with associated software. Such software requires additional regulatory approval in some jurisdictions. Cumbersome surge protection is also needed in such systems. In addition, sensor assemblies cannot be easily replaced or added to existing tables.

Systems with parallel connections between wager sensors and processors may be susceptible to individual manipulation at each wagering position, and may be difficult to install. There are also limits on the number of sensors that may be connected in parallel to the processor. Additional forms of technology may increase security in casino table wagering games, and to make installation easier and faster to accomplish.

BRIEF SUMMARY

Embodiments of the present disclosure include a gaming table apparatus, comprising: a support surface; a token sensor controller; and a first token sensor assembly operably coupled to the token sensor controller, wherein the first token sensor assembly is physically restrained by the support surface, and wherein the first token sensor assembly comprises: a container having a translucent cover for supporting a token as a wager, the translucent cover configured to pass wavelengths of visible light within a predetermined wavelength range, and substantially attenuate wavelengths of visible light outside the predetermined wavelength range; a passive ambient light sensor configured to detect a presence of the wager by: detecting ambient light through the translucent cover if the token is not placed on the translucent cover; and detecting a lack of ambient light through the translucent cover if the token is placed on the translucent cover, wherein the passive ambient light sensor is configured to operate within the predetermined wavelength range.

Another embodiment includes a token sensor assembly, comprising a container having a height and side walls that define an inside perimeter and an outside perimeter of the container, and a top surface and bottom surface of the container; a translucent cover disposed on the top surface, the translucent cover configured to filter out wavelengths in the visible spectrum that are outside a predetermined range for transmission through the translucent cover; a circuit board secured to the inside perimeter of the container; and a passive ambient light sensor disposed on a top side of the circuit board, the passive ambient light sensor configured to detect a presence of a wager if ambient light is blocked from entering the container when a token is placed on the translucent cover, wherein the passive ambient light sensor is configured to operate in low light, such as 11 lux, 20 lux or 30 lux, for example. In some embodiments, suitable sensors have a spectral response sensitivity ratio of at least 0.5 or 0.6.

Another embodiment includes a token sensor assembly, comprising a container having a height and side walls that define an inside and outside perimeter of the container, and a top surface and bottom surface; a translucent cover disposed on the top surface of the side walls; a circuit board secured to the inside perimeter of the container; a plurality of lights disposed on a top side of the circuit board; a passive ambient light sensor disposed on the top side of the circuit board; and a light controller operably coupled with the passive ambient light sensor and the plurality of lights, and configured to: control the plurality of lights to emit light that passes out of the container and through the translucent cover responsive to the passive ambient light sensor detecting a presence of a wager; and not poll a condition of the passive ambient light sensor if the plurality of lights is emitting light.

In another embodiment, a method of controlling a token sensor assembly is disclosed. The method comprises detecting an absence of a wager on a token sensor assembly if ambient light passing through a translucent cover of the token sensor assembly is sensed by a passive ambient light sensor; detecting a presence of the wager on the token sensor assembly if ambient light is blocked and not sensed by the passive ambient light sensor; generating light with a plurality of light sources from within the token sensor assembly, the generated light passing through the translucent cover and out from the token sensor assembly if the presence of the wager is detected; and ceasing to poll a condition of the ambient light sensor while the plurality of light sources are generating light.

DETAILED DESCRIPTION

Figure 1:
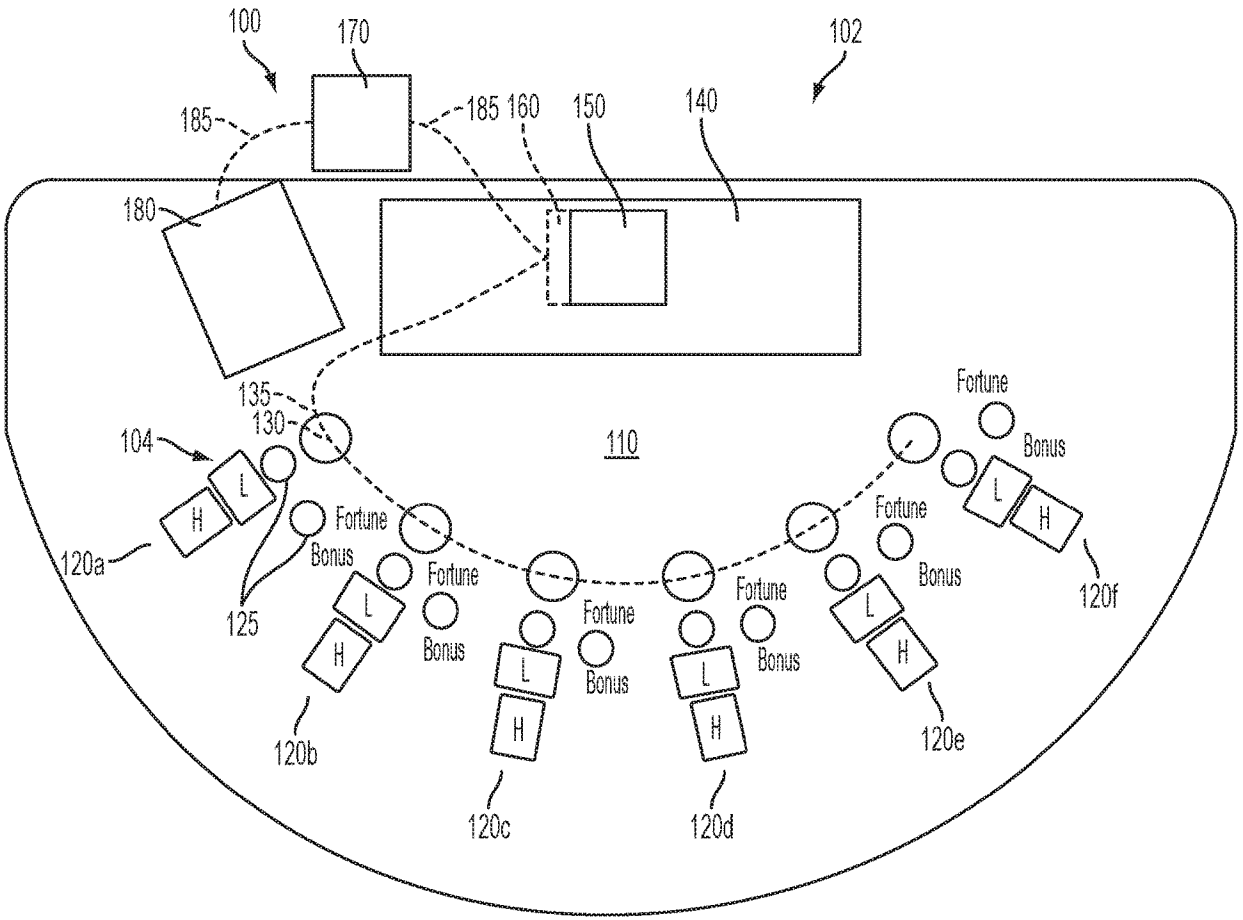
FIG. 1 is a top plan view of an exemplary gaming table apparatus with an integrated wager sensing system.

In the following description, reference is made to the accompanying drawings in which is shown, by way of illustration, specific embodiments of the present disclosure. Other embodiments may be utilized and changes may be made without departing from the scope of the disclosure. The following detailed description is not to be taken in a limiting sense, and the scope of the present invention is defined only by the appended claims.

As used herein, the term "token" is a generic term for any object that may be placed as a wager on a gaming table for a wagering game. As used herein, a token may include, for example, money, currency, coins, chips, or other similar object representing value for wagering during a particular wagering game. Tokens may be opaque in order to block ambient light from being sensed as will be discussed more fully below. In particular, tokens may be dark colored (e.g., black), which are difficult to detect using previously known wagering detection methods that rely on reflection of light from a surface of the dark-colored token. Embodiments of the present disclosure, however, may be well suited for detecting the presence of such dark-colored tokens in addition to other opaque tokens of various colors.

Token sensor data may be interpreted to determine the player positions with live wagers using a gaming table apparatus. The gaming table apparatus may include a gaming table support surface with a flexible material (e.g., a cushioning material) having electrical wires therein that provide a serial communication link between at least two sensors and a token sensor controller. For example, the flexible material may be selected from the group consisting of felt, elastomeric polymer, polymeric foam and combinations thereof. In some embodiments, each token sensor assembly may include a module that engages into a serial communication link with a first contact on each token sensor. A second contact is also provided on each token sensor assembly that engages a power source. Engaging may be effected by a quick-connect connection, by crimping, by using a screw-in connection or gripping, toggled connection or any other known electrical connection between the contacts and wiring in the gaming table apparatus.

In another embodiment, a token sensor assembly for a wagering system may include: a container having a height and side walls that define an inside and outside perimeter of the container, and a top surface and bottom surface of the container. A translucent cover and diffuser may be disposed on the top surface of the side walls of the container. A circuit board having a top side, a bottom side and an aperture disposed through both the top side and bottom side is provided. The circuit board may be secured to the inside perimeter of the container. It is to be understood that the "assembly" is referred to in various parts of this disclosure to include or exclude the translucent cover and diffuser.

To affect desired results, the translucent cover may comprise a material composition, configuration, or both, suitable to filter light such that a narrow range of wavelengths passes through the translucent cover, and the token sensor may be configured to receive and sense that narrow range of wavelengths. For example, in one embodiment, the narrow range could be from 680 nm to 750 nm in wavelength, covering much of the red visible range of the electromagnetic spectrum. In another embodiment, the narrow range may be configured for different visible colors, as desired.

As used herein, the term "passing" wavelengths of light refers to the transmissivity of light (e.g., as a percentage of its intensity) through the translucent cover. It is recognized that some, but not all light may pass through the translucent cover at some attenuated level. At some point within the visible spectrum, the wavelengths may be attenuated so that light is essentially 0% transmitted. Likewise, the sensitivity of the token sensor may have different sensitivity ratios for different wavelengths relative to the peak wavelength that is normalized to 1 (e.g., 100% sensitive). In order for light to trigger the token sensor, there must be at least some overlap in the two predetermined wavelength ranges. The predetermined range of the translucent cover is configured to attenuate some wavelengths within the visible spectrum. The token sensor may also be insensitive to certain wavelengths within the visible spectrum.

For light sources used to indicate the presence of a wager, the emission wavelength may also be selected to be within or extend through the narrow range (e.g., a light-emitting diode (LED) emitting at 730 nm), so that the light may transmit from within the token sensor assembly through the translucent cover with minimal attenuation, and so that the translucent cover would appear to the naked eye of the players and dealer to be the desired color. The translucent cover may also reduce harsh, bright light passing through the translucent cover around edges of a token, or after a token has been removed, which harsh light might annoy players at the gaming table. The translucent cover may be any light-transmitting material, such as glass, polymer, polymeric materials that can be molded, formed and machined, such as polyesters (e.g., LEXAN® polyester), polycarbonates, polyolefins (especially polypropylene, polyethylene and mixtures thereof), thermoplastic polymers and cross-linked polymers. The color of the translucent cover may be provided by dyes or pigments that cause the passing of the desired wavelengths that contribute to the colored appearance of the translucent cover. Red is a color that has been used frequently on electronic wagering areas in the gaming industry. Other colors are also contemplated. Embossing, engraving, etching and printing on the translucent cover may be used to add translucency and alphanumeric information. Translucency may also be provided by light-scattering particulates or bubbles in the composition of the cover.

The translucent cover may be removable from the top surface of the side walls of the container of a token sensor assembly without having to remove the token sensor or container from the gaming table. In this manner, the translucent covers may be tailored for individual types of wagers and individual colors by replacement of the translucent covers. For example, the translucent cover may be removable by snapping off the translucent cover by hand or with a tool, unscrewing the translucent cover or releasing a mechanical grip or lock on the cover.

Another feature useful in the practice of the present technology is the structure of the container for retaining the token sensor. The outside perimeter of the container may include at least two openings to allow electrical connection between internal components and exterior devices. One of the electric contacts may be configured to engage a power source to power the token sensor for light emission and signal sending. The other contact is configured to engage a communication link to transmit signals from the sensor to a receiver outside of the container.

The gaming table apparatus with an integrated wagering system may be made in a number of ways. For example, one general process for manufacture includes the steps of: placing at least two cushioning layers on a gaming table support surface; providing multiple openings in the two cushioning layers; providing channels in at least one of the cushioning layers and providing wiring within the channels; installing token sensors through the multiple openings in the at least one cushioning layer and onto a gaming table support surface; and engaging a signal transmitting output contact extending through an exterior surface of the token sensor with the wiring in the channel of the at least one cushioning layer.

The method may use the token sensor assembly described above, such assembly having: a container having a height and side walls, which define an inside and outside perimeter, and a top surface and bottom surface; a translucent cover disposed on the top surface of the side walls; a circuit board having a top side and a bottom side, wherein the circuit board is secured to the inside perimeter of the container; a plurality of light sources disposed on the top side of the circuit board; and at least one light sensor disposed on the top side of the circuit board to receive ambient light passing through the translucent cover. As used herein, the term "ambient light" includes light originating from an emitter outside the gaming table apparatus. The emitter may comprise artificial light, natural light or a combination thereof.

In the method, the multiple openings could be provided in the at least one cushioning layer by placing a template over the at least one cushioning layer, wherein the template defines desired locations for at least a plurality of token sensors on the gaming table support surface. The method further includes the step of cutting a plurality of recesses in the at least one cushioning layer corresponding to the desired locations on the gaming table support surface to allow insertion of at least a plurality of token sensor assemblies.

The one or more channels may be cut in a top surface of the at least one cushioning layer for accepting wiring associated with the at least a plurality of token sensors. Wiring may be provided into the one or more channels cut in the top surface of the at least one cushioning layer. At least two token sensor assemblies may be installed into the corresponding plurality of recesses and associated with the wiring provided into the one or more channels. A second cushioning layer may be placed over the at least one cushioning layer, wherein the second cushioning layer may have a plurality of recesses corresponding to the locations of the plurality of token sensors. A gaming table layout may be installed on top of the second cushioning layer, wherein the gaming table layout has a plurality of second openings cut into the layout at locations corresponding to locations of the plurality of token sensors. Preferably a grounding strap is provided that is in contact with each token sensor assembly side wall. The grounding strap is connected to an earth ground connection on the power source and can be installed either beneath the at least one cushion layer or in a channel cut in the cushion layer. The layout may be constructed of a fabric and may also be stretched over the cushioned table surface and openings cut to accommodate the token sensor assemblies. After the gaming table layout has been installed on top of the second cushioning layer, a plurality of removable translucent covers may be secured onto the corresponding token sensor assemblies.

The present system may include multiple tables with each table controller, dealer terminal, or both, connected to a server such as the commercially available GAME MANAGER™ system sold by SHFL entertainment, Inc. of Las Vegas, Nev. This system may be used to link progressive proprietary table games such as the CARIBBEAN STUD® poker game, the THREE CARD POKER PROGRESSIVE® poker game, or the PROGRESSIVE TEXAS HOLD'EM™ poker game. Examples of systems that link multiple table games with coin sensors are disclosed in U.S. Pat. Nos. 5,393,067 and 4,861,041.

Embodiments of the present disclosure include a passive ambient light sensor that detects the presence or absence of a wager based on the detection of ambient light passing from the casino floor and into the container through the translucent lens. Because reflected light is not required, the embodiments of the disclosure may be particularly well suited to detect tokens that are dark in color, have dark spots, or generally have high optical density regions.

An apparatus for sensing wagering tokens on a gaming table surface is disclosed that provides unique benefits to the modern casino environment. The low profile token sensing system that includes at least two serially connected token sensing assemblies may be mounted into a cushioning layer of a gaming table without modifications to the support surface. At least one cushioning layer is provided above the support surface, retaining associated wiring. A top surface of each token sensing assembly is flush with or elevated slightly (e.g., less than 2 mm, preferably less than 1 mm) above or below the gaming table surface, including the cushioning layer or layers. Preferably, the cushioning layer is formed of two layers of foam sheeting, a lower layer having grooves cut therein to accommodate grounding wires and live wires that run between sensors. The cushioning layer may also include a top decorative "layout felt" including markings to facilitate game play, such as pay tables, for example.

On one table, a plurality of wager sensors may be housed in low profile can structures, the tops of which rest on the support surface and have upper lens covers that are approximately flush-mounted (±2 mm) into the upper surface of the cushioning layer or decorative cover. The lower surface of each can structure is supported by the support surface such as an upper surface of a wood or wood composite table top in embodiments. Multiple wager sensor assemblies preferably are connected in series to a token sensor controller. The token sensor controller may include a field-programmable gate array (commonly known as an FPGA) or application-specific integrated circuit (ASIC), power supply, and clock generator. The token sensor controller is in communication with the dealer terminal, game controller or both. The dealer terminal may be integrated into or in communication with a game controller. Each gaming table with these components may be networked to a server through the dealer terminal, game controller or both. In some embodiments, multiple tables are connected to the server in a local area network (LAN within one pit in a casino, within one casino, or between certain tables in a casino) or a wide area progressive (WAP progressive system linking tables between one or more casinos). The number of tables that can be connected could be as few as one up to over a hundred tables, in embodiments.

A token sensor assembly includes a container structure that is preferably cylindrical and includes a centrally mounted circuit board. Preferably the circuit board is suspended centrally within the structure. The circuit board has a top side and a bottom side. The circuit board is secured to the inside perimeter of the container and is preferably spaced from both a top and bottom edge. There may be a plurality of light sources disposed on the top side of the circuit board as well as a light receiver (i.e., token sensor). Reference to the figures will further assist in an appreciation of the present technology, and provide further details and examples of these features discussed above.

FIG. 1 is an exemplary gaming table 102 with a wager sensing system 100. In some embodiments, the wager sensing system 100 senses jackpot wagers. In some embodiments, the wager sensing system 100 is configured to sense primary bets, other types of side bets, and combinations thereof. The wager sensing system 100 may be used in connection with a progressive jackpot system, such as the system disclosed in U.S. Pat. No. 5,794,964 (Jones) or in any other bonus or side bet feature system.

The gaming table 102 includes a gaming table surface 110. The gaming table surface 110 may include a felt surface with indicia printed thereon identifying elements 104 (e.g., card positions, odds, etc.) of the wagering game. The gaming table 102 may further include markings or other features delineating a plurality of player positions **120*a*-120*f* thereon. The number of player positions 120*a*-120*f* may vary depending on the particular wagering game, and on the size of the gaming table surface 110. For example, for a standard gaming table for games like TEXAS HOLD'EM BONUS® poker, THREE CARD POKER® and Pai Gow Poker, six or seven player positions 120*a*-120*f* may be provided. Because the player positions 120*a*-120*f* may be configured essentially the same, only player position 120*a*** will be described in detail.

The player position **120*a* includes conventional wager areas 125 (e.g., a primary bet area and a bonus bet area), and may also comprise a token sensor assembly 130 (e.g., a progressive wager sensor). The conventional wager areas 125 typically comprise a betting circle printed on the layout. The token sensor assemblies 130 for the plurality of player positions 120*a*-120*f* are electrically connected in series with serial wiring 135 (shown as a dotted line). Although the token sensor assembly 130** is described in this example as being used for sensing a progressive wager, it is understood that token sensor assemblies could be used for any and all wager areas without deviating from the scope of the disclosure.

The gaming table 102 may further include a chip tray 140 disposed opposite player positions **120*a*-120*f* for access by a dealer. The chip tray 140 may include an integrated dealer input and display 150 as part of the dealer terminal. The gaming table 102 may further include a token sensor controller 160 (shown in phantom), which may be disposed within the housing of the chip tray 140, within a separate housing mounted under gaming table 102, or at some other suitable location. In this example, the token sensor controller 160 is adjacent the integrated dealer input and display 150. The token sensor controller 160 is electrically connected to token sensor assemblies 130 by the serial wiring 135**.

The token sensor controller 160 may include logic (e.g., FPGA, ASIC, etc.), a power supply, and a clock generator, and any other desired component configured to perform functionality added to enhance the performance of the token sensor assembly 130.

The wager sensing system 100 further includes a game controller 170 electrically connected to the integrated dealer input and display 150 and token sensor controller 160 by system wiring 185. The wager sensing system 100 may also include an integrated card handling device 180 (e.g., a shoe, a shuffler, etc.) electrically connected to the game controller 170 by system wiring 185. The card handling device 180 may be configured with card reading functionality so that cards stored, delivered, or withheld have at least one of a suit and a rank read and that information processed, as desired. Examples of card handling devices with such card reading functionality is disclosed in U.S. Pat. Nos. 7,769,232; 7,766,332; 7,764,836; 7,717,427; 7,677,565; 7,593,544; and 7,407,438.

As discussed above, a string of multiple token sensor assemblies 130 may be electrically connected to token sensor controller 160 in series. In some embodiments, the token sensor controller 160 may manage a plurality of strings of token sensor assemblies 130 connected in a series. For example, the token sensor controller 160 may include at least two serial ports, each serial port capable of supporting up to thirty-two (32) serially connected token sensors. As a result, up to four different wagers may be reportable on each player position 120 of a seven-player table and five different wagers may be reportable on each player position 120 on a six-player table. The token sensor controller 160 may send signals to the token sensor assemblies 130 and may receive signals from the token sensor assemblies 130 to enable each token sensor assembly 130 to sense a new token, and can also place those sensors in "game over" mode in which token sensor assemblies 130 are ready to accept bets for a new round of play.

As will be discussed in further detail below, each token sensor assembly 130 may include a passive ambient light sensor configured to detect the absence or presence of a wager based on the ability to sense ambient light entering the token sensor assembly 130 through the translucent cover. The passive ambient light sensor may operate within a narrow wavelength range that at least partially overlaps with the wavelength range of the translucent cover. In addition, the circuit board in each token sensor assembly 130 may include several simple logic gates but no software runs on the circuit board. These logic gates determine which operational mode the token sensor assembly 130 is operating in, such as if the token sensor assembly 130 is reading or writing to the token sensor controller 160, reading data from the token sensor, etc.

Figure 2:
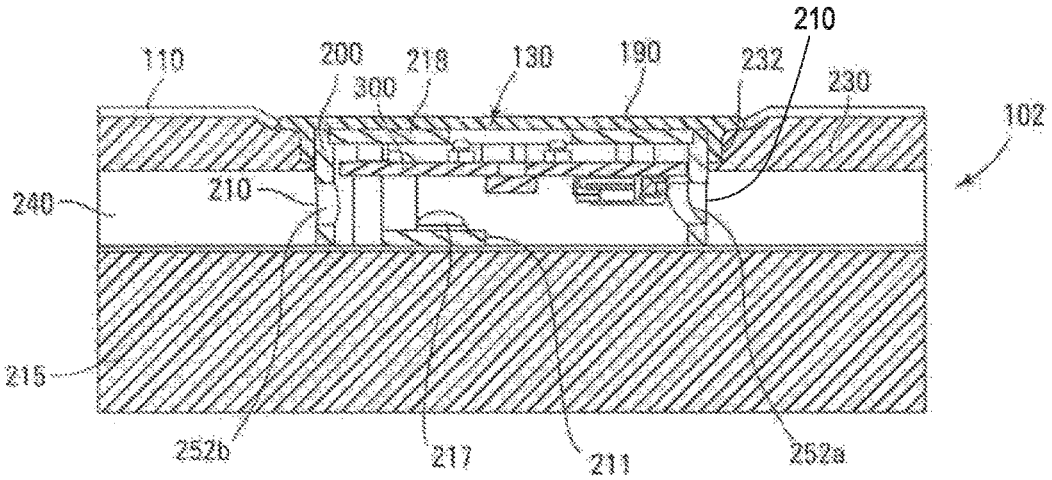
FIG. 2 is a side cross-sectional view of the exemplary token sensor assembly installed in the gaming table apparatus.

FIG. 2 is side cross-sectional view of the low profile token sensor assembly 130 installed in the gaming table 102. The gaming table 102 includes a gaming table support surface 215. The gaming table support surface 215 may comprise a layer of plywood or other rigid material. The gaming table 102 may further include a first cushioning layer 240 placed on gaming table support surface 215. The first cushioning layer 240 may be formed from foam. The first cushioning layer 240 may include plurality of openings (i.e., cylindrical holes 210) in which the token sensor assemblies 130 may be disposed. In addition, at least one channel (not shown) may be cut horizontally into the first cushioning layer 240 between holes 210. This channel is used to accommodate the serial wiring 135 (FIG. 1) and a grounding strap (not shown) between the token sensor assemblies 130. The channels may be cut in a "V" shape, "U" shape, rectangular or square shape or any other shape to accommodate the serial wiring 135.

If power is transmitted through the serial wiring 135, there is a possibility for interference. The use of a grounding strap is one method of preventing interference and/or reducing sensitivity to outside interference from electrical current flowing through wires (power and communication). Using a lower frequency in the transmission of power further may also reduce such interference problems, and in some very low frequency ranges (e.g., less than 500 Hz, e.g., 150-400 Hz or 200-350 Hz) the need for the grounding strap may be reduced and interference issues are also reduced. Data may also be transmitted at low frequency ranges because the quantity of data being transferred is small. This, in turn, allows the use of a simple resistor/capacitor solution to passing a state discharge test, for example, a required static discharge test for electronic devices.

The gaming table 102 may further include a second cushioning layer 230 installed above the first cushioning layer 240. The second cushioning layer 230 may include holes 232 corresponding to the plurality of holes 210 in which the token sensor assemblies 130 are disposed. The second cushioning layer 230 may not have corresponding channels as the absence of a second set of channels helps to smooth out the gaming table surface 110 and conceal the serial wiring 135.

The token sensor assemblies 130 may include token sensor containers 200 disposed within holes 210, 232 in the cushioning layers 240, 230. The token sensor containers 200 may be formed as cylindrical cans. The token sensor containers 200 have side walls and an integrally formed base connector 211. The base connector 211 may be configured to attach and secure the token sensor container 200 to the table support surface 215, such as with a wood screw 217, adhesive, nail, staple or other suitable securing device. The token sensor assemblies 130 may further include removable translucent covers 190 that couple (e.g., snap, screw, etc.) to the top edge of token sensor container 200 and sit relatively flush (e.g., ±2.0 mm, +1.0 mm or +0.05 mm) with the gaming table surface 110. The gaming table surface 110 may comprise a cloth cover or layout. The translucent cover 190 supports gaming tokens (not shown) being sensed by the token sensor assembly 130. The translucent cover 190 may also assist in securing the gaming table surface 110 (e.g., felt).

Figure 4:
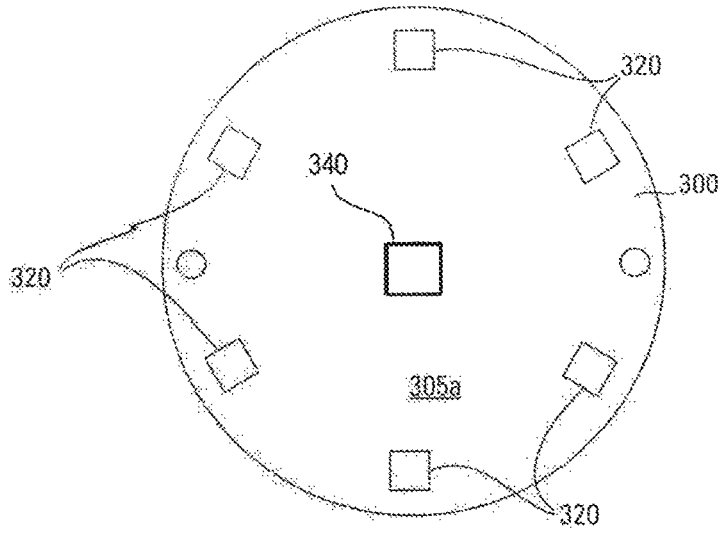
FIG. 4 is a top plan view of the exemplary token sensor circuit board.

The token sensor assembly 130 may further include a diffuser 218 positioned above the circuit board 300 within the token sensor and beneath the translucent cover 190. The diffuser 218 may be disc-shaped with an aperture that allows ambient light to reach the sensor 340 (FIG. 4). In one embodiment, the aperture is circular. The shape of the aperture and its location can vary depending upon the sensor and the position of the sensor on the board. The diffuser 218 provides a softer appearing light that is provided to indicate the presence of a wager to the player or to the house (e.g., via light sources 320 in FIG. 4). The diffuser 218 may also hide the circuitry from outside view. The translucent cover 190 may be configured to pass wavelengths of a predetermined range within a subset of the visible light spectrum, and filter out wavelengths outside that predetermined range, which may also contribute to a softer, and more appealing colored light presented to the player and dealer, in addition to somewhat concealing the diffuser 218.

Figure 3:
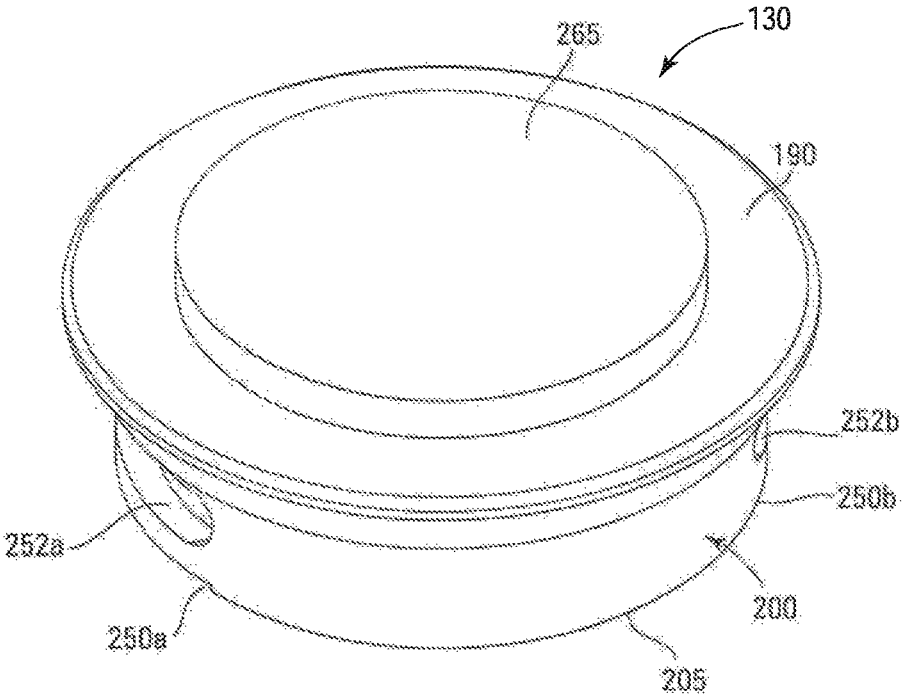
FIG. 3 is a top perspective view of an exemplary token sensor assembly, with wiring removed, and a token placed on the assembly.

FIG. 3 is a top perspective view of an exemplary token sensor assembly 130, with wiring removed, and a token 265 placed on the assembly. The token sensor container 200 has side walls 205 that define an inside and outside perimeter of token sensor container 200. The token sensor assembly 130 may include a token sensor 340 (FIG. 4) located within the token sensor container 200. The token sensor 340 may be mounted on a circuit board 300 (FIG. 4) that is secured to the inside perimeter of the token sensor container 200.

As shown in FIG. 3, one or more wiring grooves (i.e., notches 250*a*, 250*b*) are disposed around the bottom end of token sensor container 200 for the grounding strap to pass through to be connected to the token sensor 340. In addition, the token sensor container 200 may include apertures 252*a*,

252*b* (see FIG. 2) disposed around the middle of the token sensor container 200 such that the serial wiring 135 (FIG. 1) may be connected to the token sensor within the token sensor container 200.

The token sensor assembly 130 may further include the translucent cover 190, which is disposed on the top end of token sensor container 200. The translucent cover 190, in one embodiment is configured to pass wavelengths within a predetermined range of wavelengths within the visible light spectrum, which predetermined range may be selected based on the predetermined wavelength range for the spectral response of the token sensor 340 such that the two predetermined wavelength ranges overlap. In other words, the translucent cover 190 may act as a lens that allows wavelengths within the visible light spectrum to pass there through that are within the wavelength range that may be detected by the token sensor 340. For example, if the token sensor 340 is sensitive for detection within the visible red spectrum range, the translucent cover 190 may also pass wavelengths that at least partially overlap within the visible red spectrum range. Thus, the translucent cover 190 may appear red to the user. If the token sensor 340 is sensitive for detection within the visible blue spectrum range, the translucent cover 190 may pass visible light within the visible blue spectrum range. Thus, the translucent cover 190 may appear blue to the user. The wavelength range of the passed wavelengths of the translucent cover 190 may not align perfectly with the wavelength range of the spectral response of the token sensor 340; however, the two wavelength ranges need to at least partially overlap in a way to provide a sufficient amount of light detectable by the token sensor 340.

The token sensor container 200 in embodiments is low profile, such that a height of the token sensor container 200 does not exceed a combined thickness of the cushioning layer or layers, plus the thickness of the layout. The token sensor container 200 may have a total height (without the translucent cover 190) from about one-half inch to about five-eighths inch and may nest within the cushioning layer or layers, making it unnecessary to cut holes into the table support surface 215. This simplifies installation, avoids the need to modify customer tables, simplifies maintenance and reduces the down time needed to convert a conventional gaming table to a gaming table equipped with the wager sensing system 100.

Figure 5:
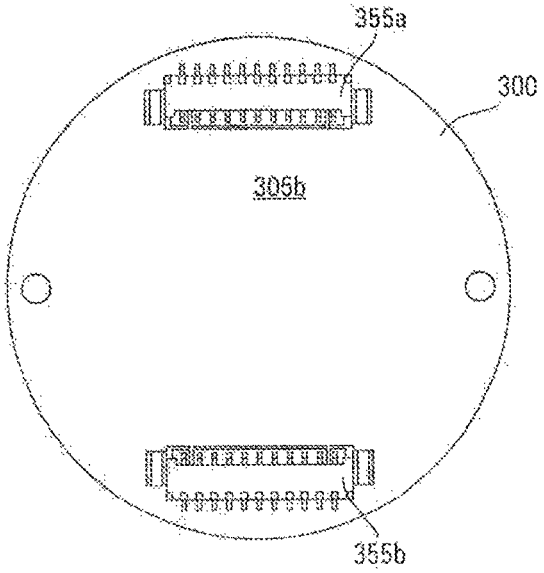
FIG. 5 is a bottom plan view of the exemplary token sensor circuit board.

FIG. 4 is a top plan view of the token sensor circuit board 300. FIG. 5 is a bottom plan view of the exemplary token sensor circuit board 300. The circuit board 300 may be secured to the inside of the token sensor container 200 (FIG. 3) with fasteners (not shown). The fasteners may be mechanical, adhesive, or other fasteners. The circuit board 300 has a top side 305*a* (FIG. 4) and a bottom side 305*b* (FIG. 5). When secured within the token sensor container 200, the top side 305*a* of the circuit board 300 may face toward the translucent cover 190 (FIG. 3), whereas the bottom side 305*b* of the circuit board 300 may face away from the translucent cover 190.

The circuit board 300 may have the token sensor 340 and the plurality of light sources 320 disposed on the top side 305*a* thereof. In some embodiments, the token sensor 340 may be mounted near the center of the circuit board 300 or other location for the token sensor 340 to be in the field of view for the ambient light entering the token sensor assembly 130 if the token 265 (FIG. 3) is not present. The center of the circuit board 300 may be desirable, particularly for embodiments employing a disc-shaped diffuser 218 (FIG. 2) with a central aperture so that the light entering the center of the token sensor assembly 130 only passes through the translucent cover 190 because of the presence of a center aperture in the disc-shaped diffuser 218.

In some embodiments, the light sources 320 may be mounted around the periphery of the circuit board 300 or other location for the light emitted by the light sources 320 to be viewed by the player and/or dealer when the token 265 is resting on the translucent cover 190. Thus, the light emitted by the light sources 320 may serve as an indication to the players and/or dealer that a wager has been made as detected by the token sensor 340.

The token sensor 340 may be a passive ambient light sensor configured to detect the presence or absence of ambient light passing through the translucent cover 190. The diameter of the token sensor 340 may be larger than the diameter of the aperture of the diffuser 218. As discussed above, the translucent cover 190 may be configured to pass a predetermined range of wavelengths of light within the visible light spectrum while attenuating other wavelengths of light outside of that predetermined range. For example, the translucent cover 190 may pass wavelengths so as to appear red, blue, green, or other colors or shades as desired. The wavelengths passed and/or attenuated by the translucent cover 190 contribute to the apparent color of the translucent cover 190. For example, a translucent cover 190 that allows light to pass with wavelengths that are red (e.g., a range between 620 nm and 750 nm, including 650 nm) while attenuating the other wavelengths may also appear to be red to the user. Similarly, a translucent cover 190 that allows light to pass with wavelengths that are green (e.g., a range between 495 nm and 570 nm, including 510 nm) while attenuating the other wavelengths may also appear to be green to the user. The same is true for translucent covers configured to pass other wavelengths (e.g., ranges including violet (380 nm-450 nm, including 400 nm), blue (450 nm-495 nm, including 475 nm), yellow (570 nm-590 nm, including 570 nm), orange (590 nm-620 nm, including 590), etc. Of course, light from the other wavelengths may still pass through the translucent cover 190 at an attenuated level; however, the attenuation may be steep, and the further away the wavelength is from the peak wavelength of the translucent cover 190, the more attenuated the light may be. For example, the peak wavelength may be centered about 680 nm with the range of about 630 nm to about 730.

The token sensor 340 may be configured to be sensitive (e.g., have a spectral response) to frequencies at or near the wavelengths passed by the translucent cover 190. It is important for the ambient light sensor of the present invention to operate with accuracy in casino lighting conditions. Casino conditions can include extremely low light (i.e., 11 lux), high light indoor conditions (i.e., up to 1,000 lux) and in rapidly changing and variable light conditions. For example, a gaming table equipped with sensors of the present invention may be physically located next to a bank of slot machines that produce blinking lights upon the occurrence of certain game events. Ranges of lux values that can be found in a casino can therefore vary between 11 and 1,000 lux, but more commonly between 11 and 400 lux. (Lux is a measure of lumens per square meter.)

Suitable sensors may be operated in a high gain mode in order to rapidly adjust to varying light conditions. Suitable sensors operate in a mode that approaches that of an on/off switch. Because other casino equipment can cause the light conditions to vary, and change frequently, it is desirable to operate the sensors in a high gain mode so that the sensor is relatively insensitive to light variations. In other words, the sensor is capable of rapidly absorbing the ambient light and generating a signal regardless of the intensity of the light or changing light conditions. In one embodiment, a sensor is capable of operating in light between 11 and 400 lux.

Figure 9:
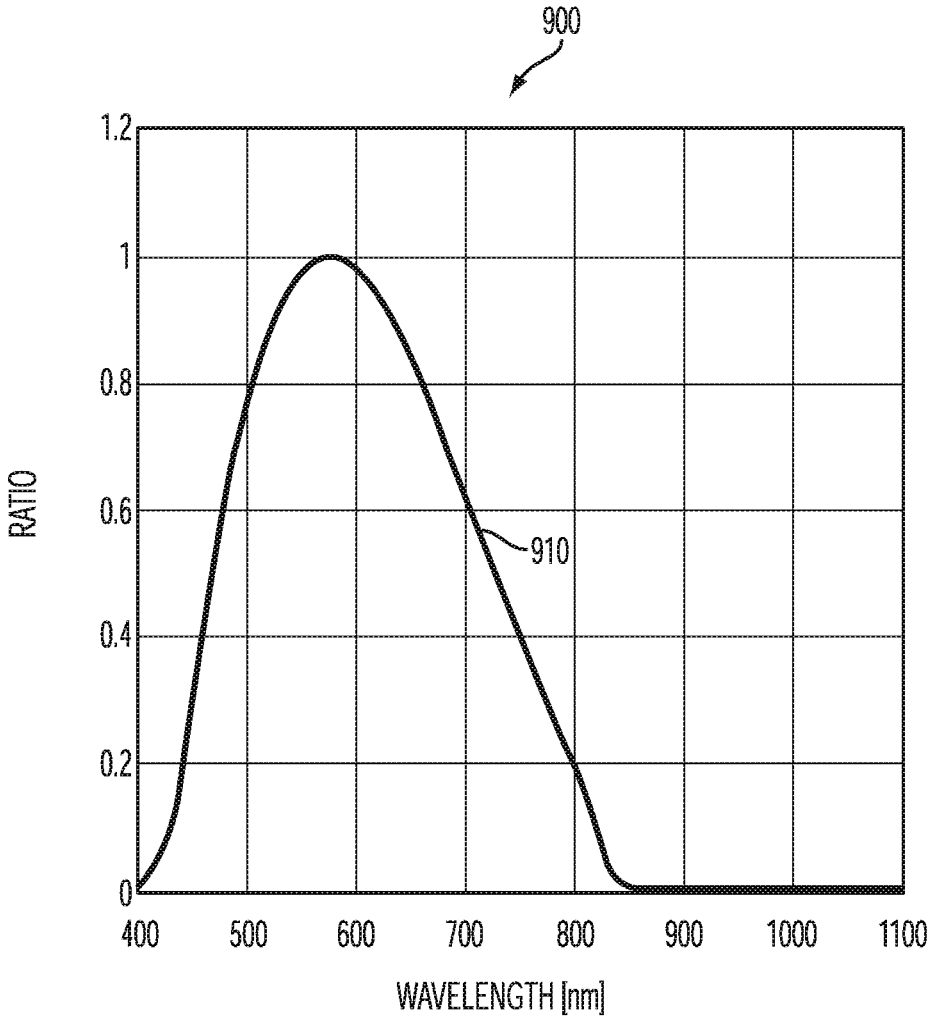
FIG. 9 is a graph illustrating a spectral response of a token sensor.

Because of the wavelengths passed by the translucent cover 190 within a predetermined range, wavelengths outside of the predetermined wavelength range may be attenuated (e.g., filtered out) before reaching the token sensor 340. An example of such a suitable sensor is the BH1600FVC analog current output type ambient light sensor available from ROHM Semiconductor of Kyoto, Japan. The BH1600FVC sensor has a spectral response 910 shown in the graph 900 of FIG. 9. While such a sensor may have a spectral response 910 to wavelengths from about 400 nm to about 830 nm (corresponding to roughly the visible light range of 390 nm to 700 nm), the token sensor 340 may be more responsive at or near its peak wavelength of about 560 nm. Wavelengths from about 500 nm to 660 nm may generate a response that has approximately 0.8 sensitivity ratio and above. The sensitivity ratio sets its peak wavelength to be normalized at 1, and the other wavelengths' sensitivity is measured as a percentage of the sensitivity of the peak wavelength.

While such a sensor may be appropriate for a translucent cover 190 that passes wavelengths near the visible yellow wavelength (570 nm), other wavelengths (e.g., orange (590 nm), red (650 nm)) may also be within a tolerance from the peak (e.g., 0.8 sensitivity ratio) such that the received light by the token sensor 340 may also produce strong enough signals for obtaining a valid detection that a wager is not present. The tolerance for receiving wavelengths within the token sensor's sensitivity ratio of 0.8 and above may still produce a strong enough light to trigger the token sensor 340, whereas a wavelength near the token sensor's sensitivity ratio of 0.6 may require that the wavelength be closer to the peak wavelength passed by the translucent cover 190. For example, light having a wavelength that is only 30% transmissive through the translucent cover 190 may be sufficient if the sensitivity ratio of the token sensor 340 at that wavelength is 90%. Other combinations are contemplated, which may depend on the transmissivity of the wavelength through the translucent cover 190, the sensitivity ratio at that wavelength, the overall intensity of the light, and other characteristics of the token sensor 340. For example, operating the token sensor 340 and operational amplifier in a high gain mode may further reduce the amount of overlap and intensity that is required to trigger the token sensor 340.

In addition, the light sources 320 (FIG. 4) may be configured to emit a light having a wavelength (or wavelengths) that is within the predetermined range of wavelengths passed by the translucent cover 190. As a result, the translucent cover 190 and the light emitted by the light sources 320 may appear to be the same color. For example, both the translucent cover 190 and the light sources 320 may appear to be red, green, blue, or other color as desired. As a result, the light from the light sources 320 that passes through the translucent cover 190 to the player and/or dealer may be stronger and more aesthetically pleasing.

Referring now to FIG. 5, the circuit board 300 may also have a plurality of wiring connectors 355*a*, 355*b* disposed on the bottom side 305*b* thereof. The wiring connectors 355*a*, 355*b* may be coupled with the serial wiring 135 (FIG. 1), such as by snap-in, screw in, mechanical clamping or other fastening methods. The wiring connectors 355*a*, 355*b* may be used to serially connect multiple token sensors 340 from the plurality of token sensor assemblies 130 to the token sensor controller 160 (FIG. 1) and/or the power supply (not shown).

FIGS. 3-5 will now be referred to together. In operation, the token 265 may be placed on the translucent cover 190 of the token sensor assembly 130. The token 265 may be substantially opaque thereby blocking the ambient light of the room (e.g., casino) from entering the token sensor container 200. The presence of the token 265 may be sensed by the token sensor 340 based on the detection (or absence of) ambient light received through the translucent cover 190. For example, if the token 265 is placed on the translucent cover 190, the token sensor 340 may detect the absence of ambient light being received. The token sensor 340 may generate a signal indicating the absence of light detected by token sensor controller 160 (FIG. 1), and the signal may be transmitted to the game controller 170 (FIG. 1). If the game controller 170 receives the signal(s) from the token sensor controller 160, the game controller 170 may associate the sensed token signal with a player position, such as player position number one, and optionally identifies the type of wager (e.g., base game wager, progressive wager, bonus wager, side bet wager, etc.). The recognition of the type of wager and the player position may be accomplished by a look-up table, an algorithm, an initialization program, or the like.

A signal from the token sensor 340 may be sent to a memory logic gate 417 (FIG. 7D), which is read by the token sensor controller 160. The token sensor controller 160 may also send a signal to the token sensor assembly 130 to enable the light sources 320, which provides a visual indication of the placement of a wager at an appropriate time during play of a casino table game. The light sources 320 may initially flash in a predetermined pattern until a dealer locks the bets via dealer input and display 150 (FIG. 1). Upon locking the bets, the light sources 320 may remain lit in a continuous "on mode" until the end of the round. In this fashion, even if token 265 is removed from token sensor assembly 130 (which is often done to collect a non-refundable jackpot wager or some side bets), the light sources 320 will remain illuminated. Additionally, the dealer may "unlock" the ability to place wagers via the dealer input and display 150 to allow a player to add or remove a bet just prior to dealing cards. Because the game controller 170 (FIG. 1) may receive hand information from a card handling device 180 (FIG. 1), once a win is determined, another signal from game controller 170 may cause token sensor assemblies 130 to blink in another predetermined pattern.

The light sources 320 are contained within the token sensor container 200 and generate light from within the token sensor assembly 130 that passes through the diffuser 218 (FIG. 2) and translucent cover 190 (e.g., around the periphery of the token 265) to be visible by the players and/or dealer. While the light sources 320 are illuminated, some of the light from the light sources 320 may be sensed by the token sensor 340. As a result, the token sensor 340 may have a misread because light was still detected from within the token sensor assembly 340 even though the token 265 remains on the translucent cover 190 blocking the entry of ambient light from the room. In other words, the light emitted by the light sources 320 may cause the token sensor 340 to not sense a token when placed on the translucent cover 190.

In some embodiments, the token sensor assembly 130 may be configured to not poll a condition of the token sensor 340 while the light sources 320 are illuminating regardless of whether or not the token 265 is placed on the translucent cover 190. The illumination may occur while the light sources 320 are flashing, such that the token sensor assembly 130 alternates between polling the condition of the token sensor 340 when the light sources 320 are off, and not polling the condition of the token sensor 340 when the light sources 320 are on. For example, in some embodiments, the token sensor assembly 130 may be configured to ignore the signal generated by the token sensor 340 while the light sources 320 are illuminated. For example, the token sensor assembly 130 may ignore the signal through control logic within the token sensor assembly 130 if the token sensor assembly 130 receives feedback that light was detected while the light sources were emitting. In some embodiments, the token sensor 340 may be deactivated, such that the signal may not be generated by the token sensor 340 while the light sources 320 are illuminated. In some embodiments, the token sensor assembly 130 may include a mechanical element placed between the token sensor 340 and the light sources 320 such that the illuminated light from the light sources 320 is blocked from being received by the token sensor 340.

Figure 6:
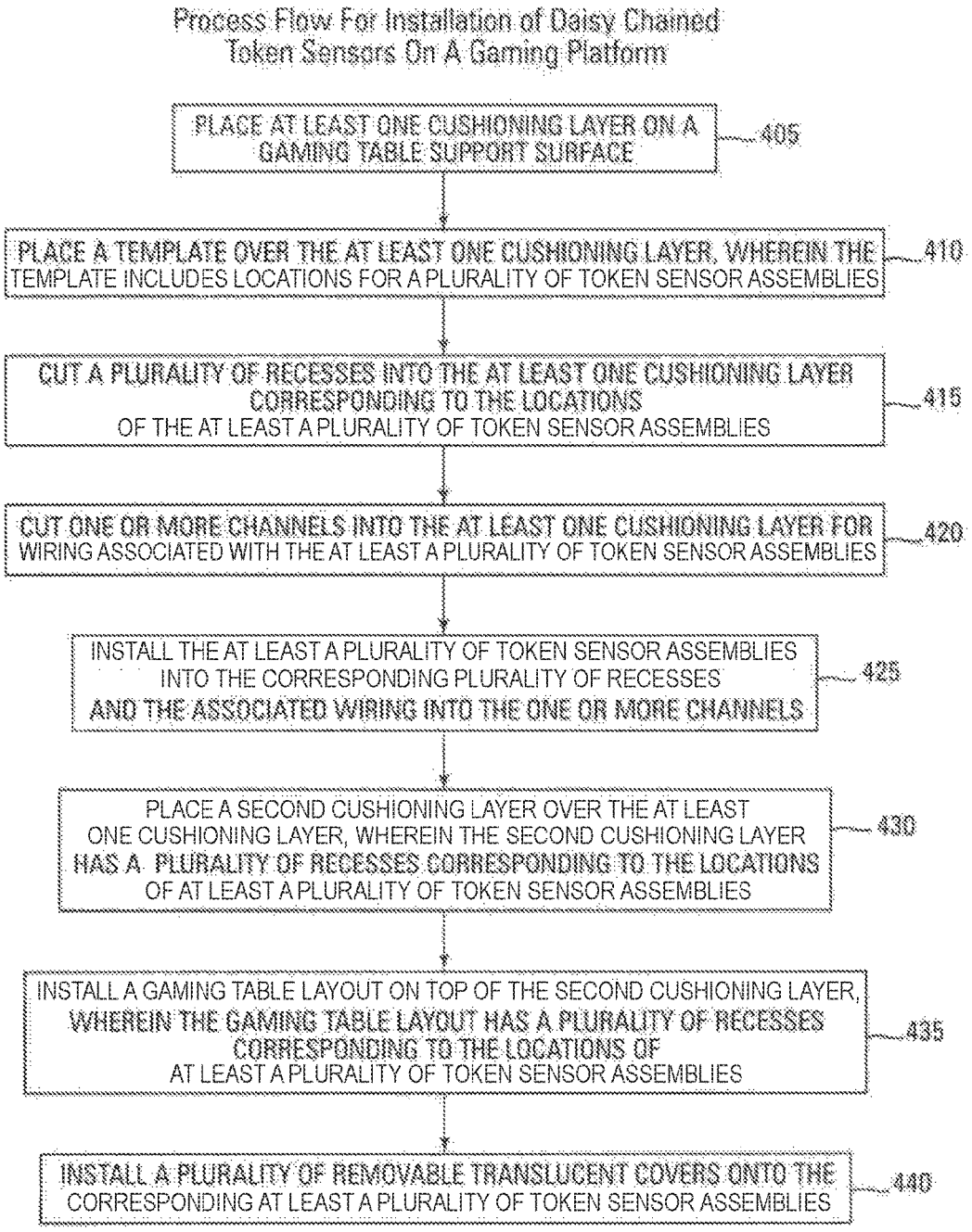
FIG. 6 is a process flowchart for an exemplary method of installation of a gaming table apparatus with an integrated wagering system.

FIG. 6 is a process flowchart for an exemplary method of installation of a gaming table apparatus with an integrated wagering system. The method includes at operation 405, placing at least one cushioning layer on a gaming table surface. At operation 410, a template is placed on top of at least one cushioning layer 240. The template contains a plurality of identified locations for installing the plurality of token sensor assemblies 130. At operation 415, the plurality of recesses 210 is shown to be cut into the at least one cushioning layer 240 corresponding to the locations of the plurality of token sensor assemblies 130. Preferably, a second cushioning layer 230 and felt gaming table surface 110 are cut at about the same time as the at least one cushioning layer 240. In that event, second cushioning layer 230 and gaming table surface 110 would be removed before proceeding to operation 420. At operation 420, one or more channels (not shown) are cut into the at least one cushioning layer 240 to accommodate serial wiring 135. Preferably, the channel is cut in an inverted "V" shape and the cushioning material from the center of the channel is removed. In this manner, the top surface of the at least one cushioning layer 240 over one or more channels remains essentially intact leaving a slit through which serial wiring 135 and a grounding strap may be pushed into the channel. Additionally, a grounding strap may replace a traditional grounding plate that eases installation and reduces costs. In other embodiments, the channel is cut in the shape of a "V," "U," square or rectangle, and a second cushioned layer is positioned over the lower channeled layer to enclose the channel.

Once the plurality of recesses 210 and one or more channels (not shown) have been cut into first cushioning layer 240, at operation 425 token sensor assemblies 130, serial wiring 135 and a grounding strap may be installed in the respective openings or holes 210 and channels. After installing serial wiring 135 and the grounding strap into the channel, at operation 430 second cushioning layer 230 may then be installed. Alternatively, token sensor assemblies 130 may be installed after placing second cushioning layer 230 over the at least one cushioning layer 240. At operation 435, the gaming table surface 110 (e.g., felt) is placed over second cushioning layer 230. Finally, at operation 440, a plurality of removable translucent covers 190 are installed, i.e., "snapped" onto the top end of the respective plurality of token sensor containers 200, thereby securing the gaming table surface 110 (e.g., felt) around token sensor assemblies 130. In one embodiment, each token sensor assembly 130 is fastened to the table support surface 215 by a fastener, such as a screw, staple, nail, adhesive or the like. A conventional wood screw is a suitable device for attaching each assembly to the table. During fastening, the grounding strap (not shown) may be positioned under oppositely spaced notches 250*a*, 250*b* (shown in FIG. 3) so that each assembly is properly grounded to earth ground. The other wires may be fastened to the circuit board 300 at connectors 355*a*, 355*b* through apertures 252*a*, 252*b*.

Figures 7, 7A, 7B, 7C, 7D, 7E:
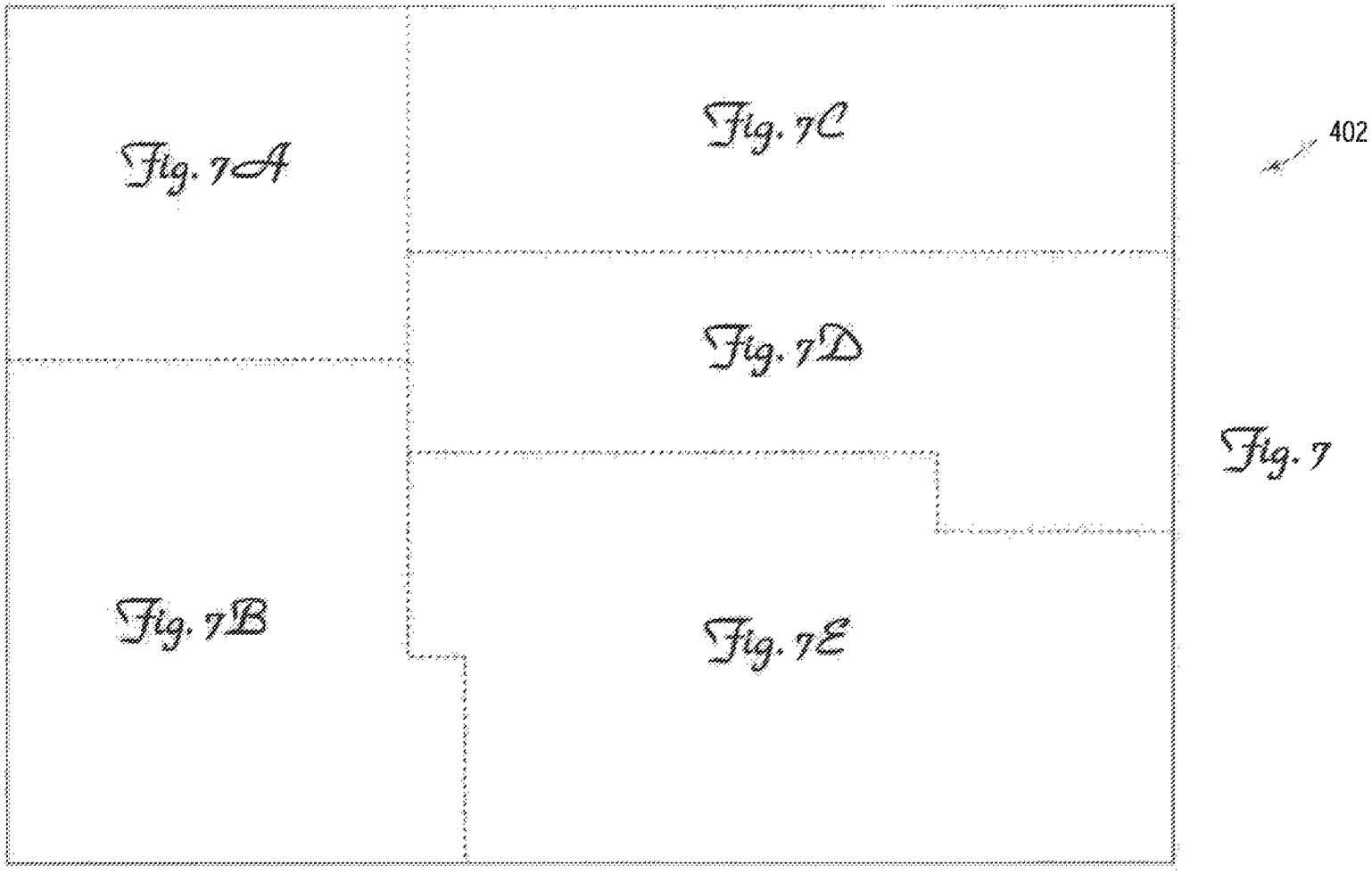
FIG. 7 is an electrical block diagram for a schematic of an assembly of token sensor circuits having segments 7A, 7B, 7C, 7D and 7E in the assembly.
FIG. 7A is an electrical schematic of segment 7A from FIG. 7.
FIG. 7B is an electrical schematic of segment 7B from FIG. 7.
FIG. 7C is an electrical schematic of segment 7C from FIG. 7.
FIG. 7D is an electrical schematic of segment 7D from FIG. 7.
FIG. 7E is an electrical schematic of segment 7E from FIG. 7.
Figure 7A:
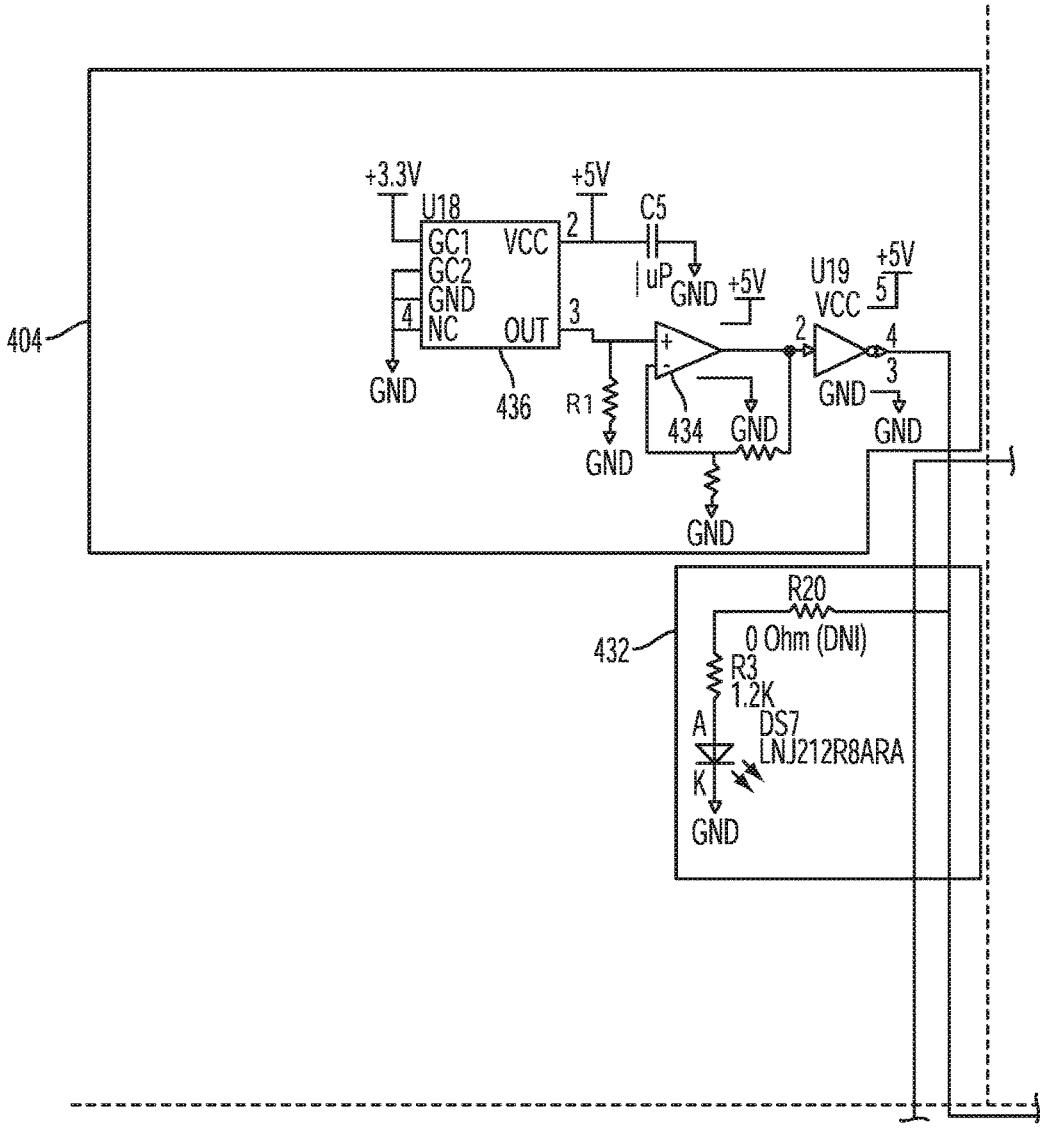
Figure 7B:
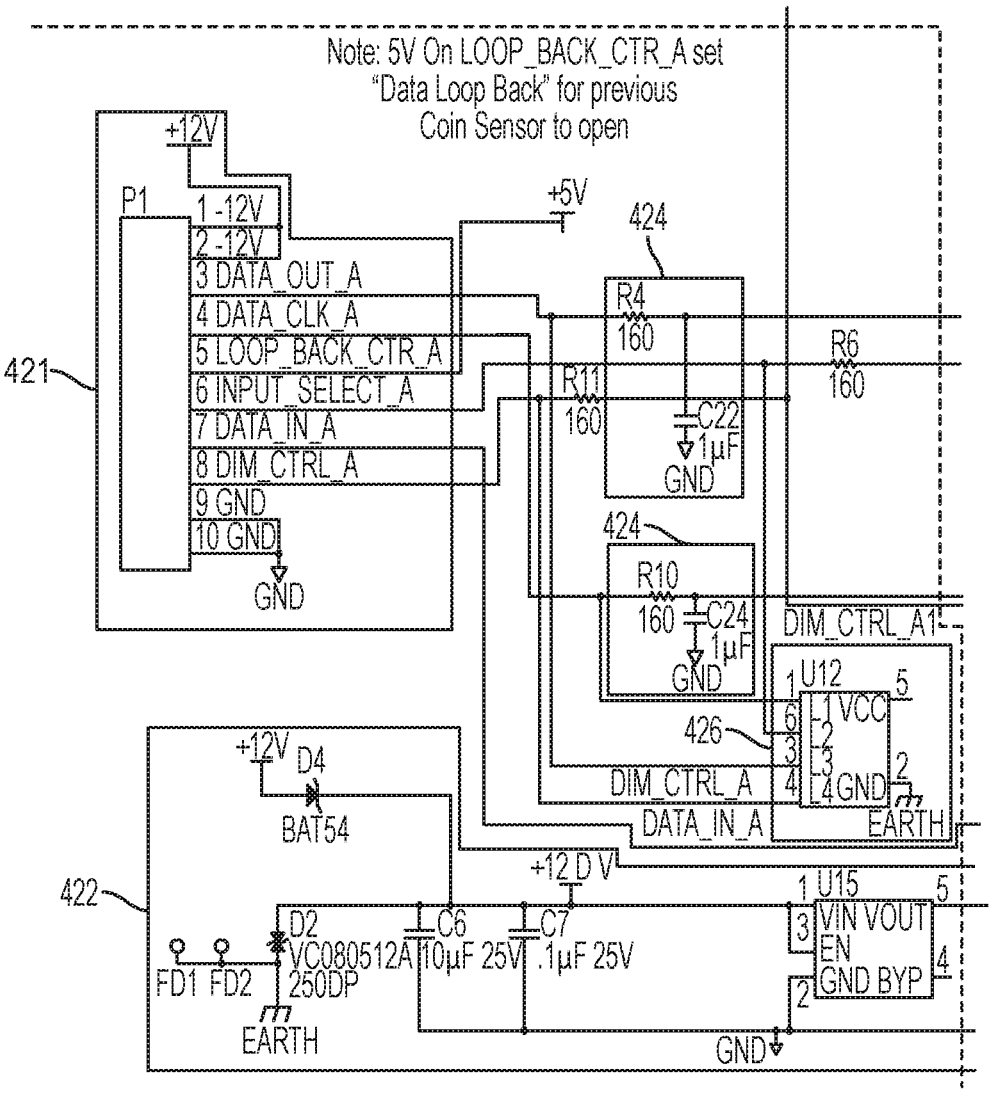
Figure 7C:
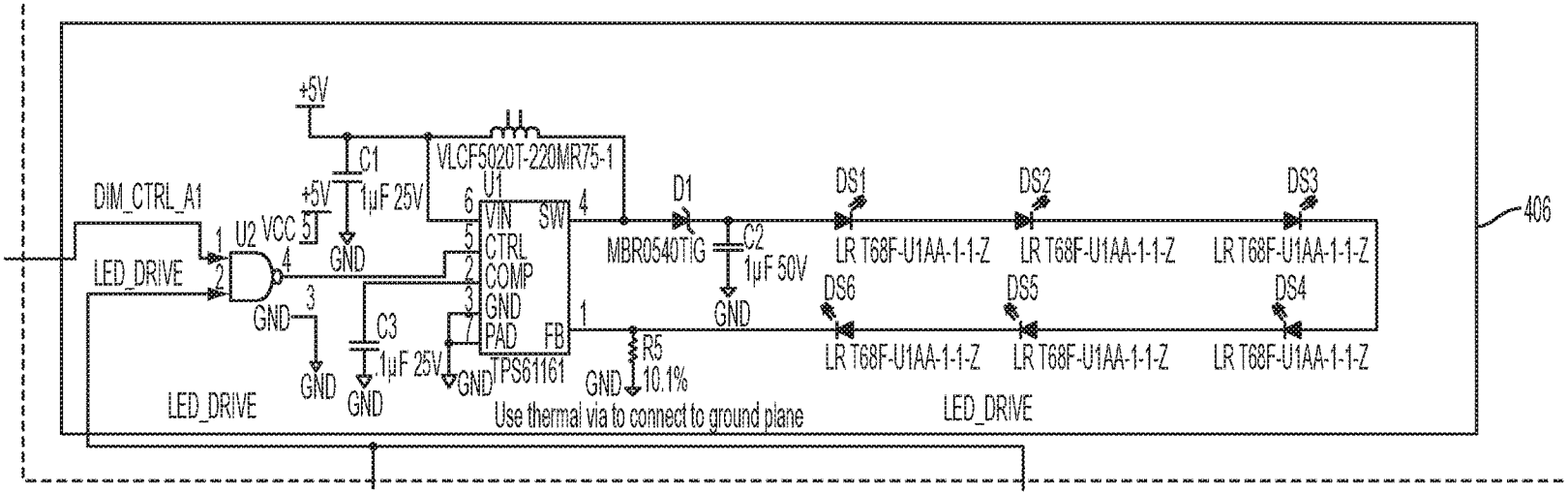
Figure 7D:
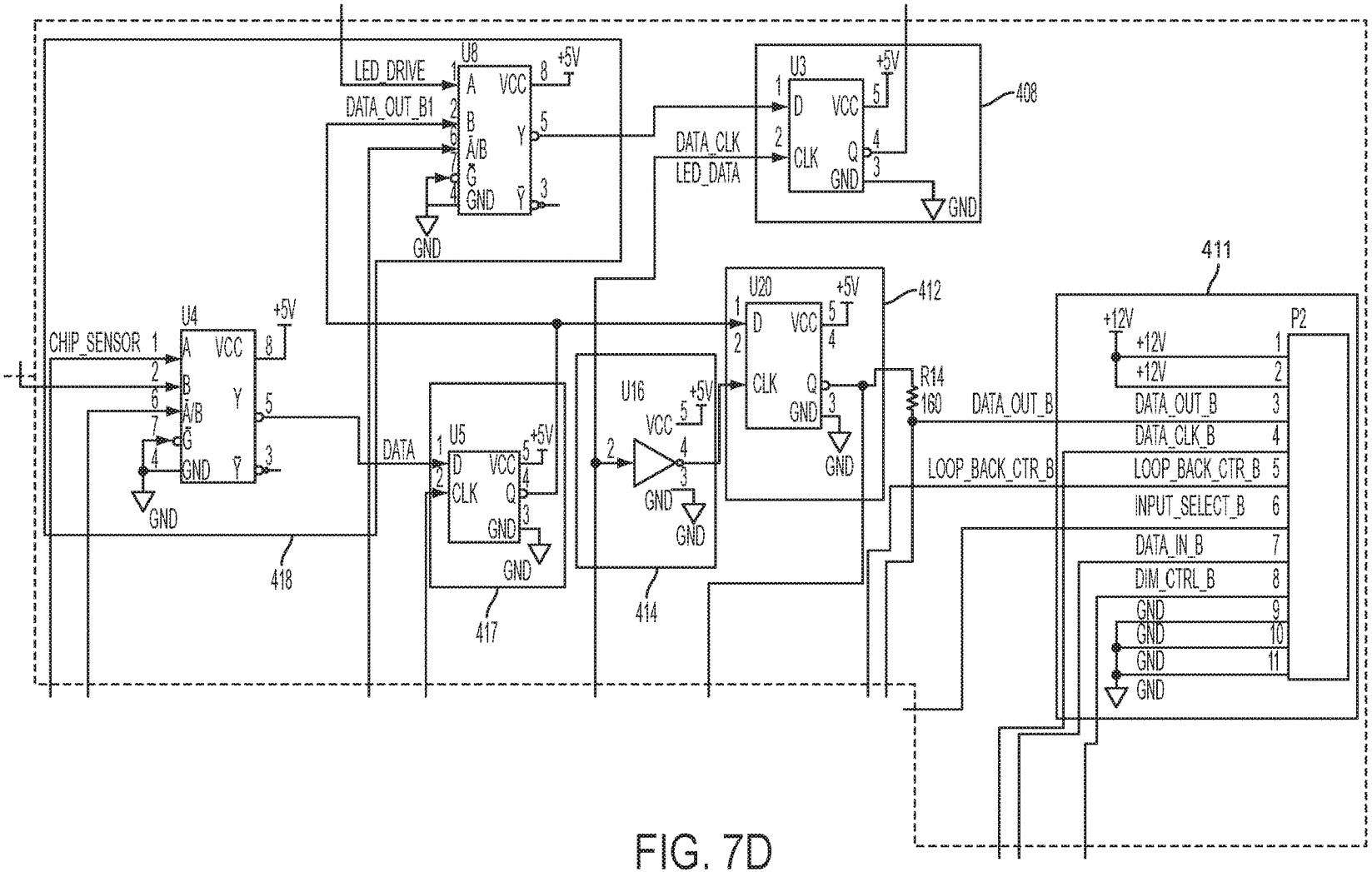
Figure 7E:
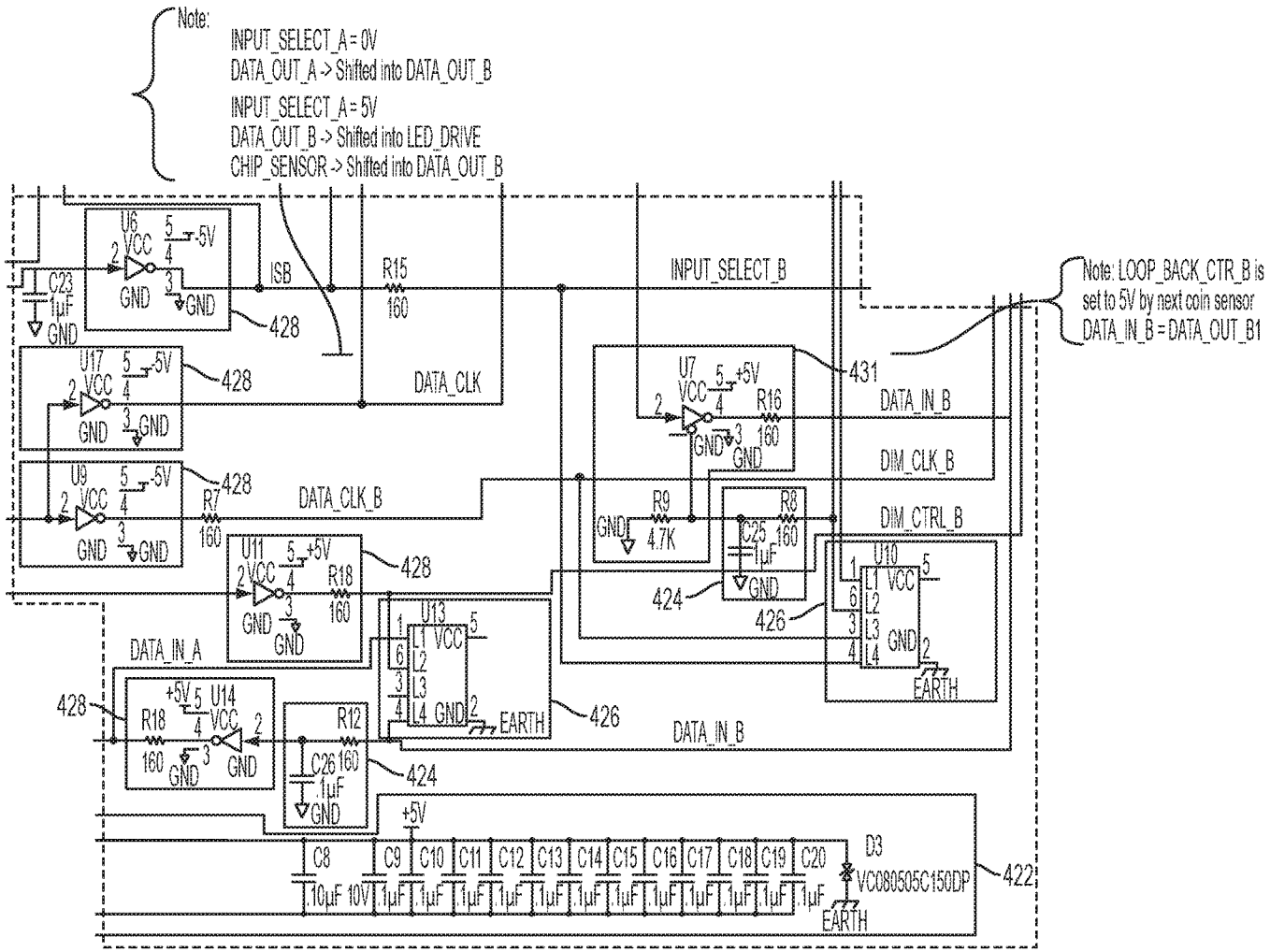

FIG. 7 shows the schematic of the electronic circuitry of an individual token sensor assembly 402, with the schematic being shown in sections in FIGS. 7A-7E. In other words, FIG. 7A is an electrical schematic of segment 7A from FIG. 7; FIG. 7B is an electrical schematic of segment 7B from FIG. 7; FIG. 7C is an electrical schematic of segment 7C from FIG. 7; FIG. 7D is an electrical schematic of segment 7D from FIG. 7; and FIG. 7E is an electrical schematic of segment 7E from FIG. 7.

Components include: a sensor sub-circuit 404 (FIG. 7A), a power indicator light 432 (FIG. 7A), an operational amplifier 434 (FIG. 7A), a lamp controller circuit 406 (FIG. 7C), lamp output controller 408 (FIG. 7D), first connector 411 (FIG. 7D) to transmit signals (or not) to an adjacent token sensor through a serial connection, additional memory 412 (FIG. 7D), an inverter 414 (FIG. 7D), system memory 416 (FIG. 7D), sensor mode controller 418 (FIG. 7D), second connector 421 (FIG. 7B), power input circuit 422 (FIGS. 7B, 7E), time-constant resistor capacitors 424 (FIGS. 7B, 7E), surge suppressor 426 (FIGS. 7B, 7E), drivers 428 (FIG. 7E), and loopback switch 431 (FIG. 7E).

Referring to FIG. 7A, the sensor sub-circuit 404 may include a token sensor 436 operably coupled with the operational amplifier 434. The token sensor 436 may be an ambient light sensor configured to determine whether a token is placed on the token sensor assembly 130 based on the presence or absence of ambient light received through the translucent cover 190 as discussed above. For example, the token sensor 436 may be configured similar to the token sensor 340 by being sensitive to wavelengths that correspond to the wavelengths allowed to pass through the translucent cover 190, as discussed above with respect to FIG. 4.

The token sensor 436 may be configured to operate in a high gain mode (e.g., through setting an input to the token sensor 436), which may have a gain in the order of 100× or more. The high gain mode may cause the operational amplifier 434 to saturate even with a low level of ambient light. As a result, the token sensor 436 may be able to operate in a wide range of ambient light conditions. For example, the high gain mode of the token sensor 436 may enable the token sensor 436 to sense low light levels (i.e., as low as 11 lux) as long as there is sufficient ambient light to just trigger the token sensor 436. In addition, once the operational amplifier is saturated, the token sensor 436 may be insensitive to variations in light levels in the ambient light, which may be useful in casinos where there is a lot of flashing lights and other rapid changes in the lighting in the environment. Further gain may be added by selecting the input resistor (R1) to the operational amplifier 434 to raise the voltage on the input to the operational amplifier 434. Setting the gain too high, however, may have the tradeoff of false triggers, for example, if some light was to leak around the edges of the token placed on the translucent cover 190.

The power indicator light 432 may be coupled to the output of the sensor sub-circuit 404 to indicate whether the sensor sub-circuit 404 circuit has power. The power indicator light 432 may be turned off or on when necessary for testing.

Referring to FIG. 7B, the second connector 421 may be connected to an adjacent token sensor assembly 130, the token sensor controller 160, or not at all depending on the location of the token sensor assembly 130 within the serial string of token sensor assemblies 130. The power input circuit 422 provides power to the token sensor assembly 130. The time-constant resistor capacitors 424 may be configured to flatten the spike output from the surge suppressor 426 in the event of a power surge.

The connector 421 may be an input connector configured to receive signals from the previous token sensor assembly in the serial string. The connector 421 may include the following inputs:

Data Out A may be the output of the previous token sensor assembly or the token sensor controller 160.

Data Clock A may be a clock signal (e.g., 250 Hz). This clock signal is sent from the token sensor controller 160 and the frequency may not be changed by the token sensor assembly;

Loopback Ctrl A may be 5 V if the token sensor assembly in the serial string is not the last token sensor assembly;

Input Select A may be signal used for selection of Mode 1 or Mode 2;

Data In A may be the feedback to the controller; and

Dim Ctrl A may control the brightness of the light sources of the token sensor assembly.

Referring to FIG. 7C, the lamp controller circuit 406 is configured to control the light sources of the token sensor assembly. In FIG. 7C, the light sources are labeled DS1-DS6. In operation, when the player places an opaque token on the translucent cover 190, the lamp controller circuit 406 may turn the light sources on or off, change brightness, display a pattern, etc., to indicate that a wager has been made. The control of the light sources DS1-DS6 may depend on the LED drive signal and the DIM control signal input into an AND gate. If the LED drive signal is high, it may be an indication that a wager has been made. The DIM control signal may be received from the controller to control whether the light sources should flash, be held high, or turn off.

Referring to FIG. 7D, the sensor mode controller 418 is configured to operate each token sensor assembly 402 in one of at least two modes. In addition, the sensor mode controller 418 can perform a number of operations on each token sensor assembly 402. The sensor mode controller 418 may be configured to cause a cycle to begin sensing, turning lights on and off, and restarting a new cycle of token sensing with the initiation of a new round of play of the game. The sensor mode controller 418 may also provide a simple clock pulse that is connected to one of the wires and, for the simplest example, this clock pulse is the same for each of the token sensor assemblies 402 because of the manner in which the sensors are serially wired together. Another function of the sensor mode controller 418 is change the mode of the token sensor assemblies. All of the token sensor assemblies may be simultaneously in the same mode because they are wired together serially. The mode of each sensor changes together at different stages of the wagering game, from an unlit to lit condition, and then back again. The sensor mode controller 418 may receive the data signal from the token sensor 436 (FIG. 7A) and the Data Out A signal from the connector 421 (from the previous token sensor assembly). The Data Select A signal controls the sensor mode controller 418 to output either the data signal from the token sensor 436 or the Data Out A signal from the connector 421. The data output from the sensor mode controller 418 is sent to the system memory 416, which may be a one bit memory chip (e.g., flip-flop) that stores the data and outputs the data responsive to the clock (clk) input (e.g., on the rising edge) to the system memory 416. The data may then be transmitted from the system memory 416 as Data Out B to both the LED driver (to drive the light sources DS1-DS6) and to the first connector 411 to be sent to the next token sensor assembly 130. The data may be transmitted to the connector through another memory 412 (e.g., flip-flop) that may act as a buffer to slow down the Data Out B signal from shifting too fast causing a race condition. In addition, an inverter 414 may receive the clock signal (clk) to control operation of the additional memory 412. The inverter 414 may cause the Data Out B to change on the falling edge of the clock.

The token sensor assemblies 130 may have different operational modes.

Mode 1 is the Read/Write Mode.

In Mode 1, the sensor reads data stored in the system memory 416 and that data in the system memory 416 is further sent to the lamp output controller 408 to control whether to turn off or on the light sources (FIG. 7C) as according to the DATA OUT signal output by the sensor mode controller 418. Thus, during read mode, the data on the Data Out B signal corresponds to the output from the token sensor 436 that indicates whether a wager has been made and detected.

Mode 2 is the Shift Mode.

In Mode 2, the sensor mode controller 418 transfers the desired state of the lights to the memory 416 by outputting the desired state of the lights, one at a time, to each of the token sensor assemblies 130. If there are three token sensor assemblies, the controller may use three cycles to transfer the desired state to the first token sensor connected to the controller. During each cycle, the desired state is shifted to the next serially connected token sensor assembly. This mode is also used to read the memory in each token sensor. It takes two cycles to read the memory of the three token sensors.

In Mode 2 and during each cycle, data is shifted from the memory 416, then to the adjacent token sensor assembly 130, and then to another adjacent token sensor assembly and so on until all sensor memories 416 are loaded with data.

This mode is used to transfer the actual state of the token sensor assembly to the controller. The state that was in the memory 416 at the start of the cycle is also used to light the light sources DS1-DS6 because the LED drive is fed back into the sensor mode controller 418 and passed to the lamp output controller 408 to control the light sources rather than the output from the sensor mode controller 418. As a result, the new token sensor state (received from the previous token sensor assembly while being shifted) is stored in memory 416 at the same time the current state of the memory is 418 used to control the light sources DS1-DS6 in the token sensor assembly 130.

Before the first cycle, the token sensor controller 160 can read the memory 416 of the third token sensor assembly 413, which is the token sensor assembly 413 directly connected to the token sensor controller 160. After the first cycle, the state of each token sensor assembly is transferred to the next token sensor assembly in the serial string. After the first cycle, the state of the memory 416 in the second token sensor assembly is transferred to the third token sensor assembly. After the first cycle, the state of the memory 416 in the first token sensor assembly is transferred to the second token sensor assembly. Before the second cycle, the state of the second token sensor assembly is read by the token sensor controller 160 because the third token sensor memory 416 now holds the information that was in the second token sensor assembly. After the second cycle, the state of the memory 416 in the second token sensor is transferred to the third token sensor assembly. After the second cycle, the state of the memory 416 in the first token sensor assembly is transferred to the second token sensor assembly. Now, the third token sensor assembly memory 416 contains the information from the first token sensor assembly. Now, the token sensor controller 160 can read the information that was in the first token sensor because it has been transferred to the third token sensor assembly by the controller giving the token sensor assemblies two cycles. The token sensor controller 160 can read a different number of token sensors in a similar manner.

The token sensor controller 160 may also use Mode 2 to determine the number of token sensor assemblies by transferring digital data patterns into the first token sensor assemblies and reading the memory 416 of the final token sensor assembly. There is a switch built into each sensor that allows the last token sensor assembly to either connect the memory 416 in the token sensor assembly to the next token sensor assembly or return it to the token sensor controller 160. This switch is activated if the last token sensor does not have anything connected to it. This allows each token sensor assembly to be connected to the next token sensor assembly using the same wire cable.

Among benefits of the serial arrangement are:

1. Simple wiring;
2. Allows for simple surge protection to be able to easily pass a 27 kV shock test;
3. Simple low cost circuit;
4. Each token sensor is the same and can be readily replaced without interfering with the ability of operating token sensors to continue working during play of games;
5. The position of each token sensor assembly is determined by its location in the serial string;
6. Ease of initial installation;
7. Allows for simple grounding of all token sensor assemblies that only requires a ground strap to follow the serial string;
8. The simple circuit allows for a simple low profile housing that makes installation simple; and
9. Allows for easily changing the number of token sensor assemblies to be changed by simply adding more in the serial string.

Example 1

The token sensor 436 reads a token at the start of the cycle by detecting that the token blocked the ambient light passing through the translucent cover 190. Because it is the first cycle, no data is found in the memory 416. That information (i.e., no data) is transferred to the light sources. As a result, the light sources remain off. After the cycle, the token sensor 436 may again read the token, and that information (i.e., data indicating a wager) is copied into the memory 416. This puts information into memory 416 that a token is present and the light is turned on in an appropriate mode (e.g., flashing before lock-out of bets, and continuously after lock-out of bets).

Example 2

Assuming that the first and last token sensors are serially connected to the controller, the following conditions exist:

Before the cycle, the second token sensor memory contains something and the first and third token sensor memory contains no data. After the cycle, the information from the controller is transferred to the first token sensor. The information from the first token sensor is transferred to the second token sensor. The information from the second token sensor is transferred to the third token sensor. The information from the third token sensor is transferred to the controller.

It takes three cycles to transfer new data into the three token sensors. It takes two cycles to transfer the data that was in the token sensors to the controller.

To read three token sensors and set the lights, the following steps are used.

Step 1: The controller sets the token sensor assembly in Mode 2 and in three cycles the state of the desired lights is transferred to the memory in the token sensor assembly.

Step 2: After the three cycles that transferred the desired state of the lights into the memory of each token sensor assembly, the mode of the token sensor assembly is changed to Mode 2.

Step 3: In one cycle, the information read by the token sensor is transferred to the memory and the information in the memory is used to energize the light.

Step 4: The token sensor assembly are changed to Mode 1.

In two cycles, the information is transferred from the token sensor assembly's memory to the token sensor controller.

The connector 411 may be an output connector that sends data and signals to the next token sensor assembly in the serial string. The connector 411 may include the following outputs:

Data Out B—The output of the token sensor assembly. If the token sensor assembly is connected to another token sensor assembly from the output, then this line will become data out A on the next token sensor assembly.

Data Clock B—250 Hz clock signal. If the token sensor assembly is connected to another token sensor assembly from the output, then this line will become data clock A on the next token sensor assembly.

Loopback Switch Ctrl B—If the token sensor assembly is connected to another token sensor assembly then the line will be at 5 V (binary 1). If not, then the line will be at 0 V (binary 0) and the token sensor controller will know that this token sensor assembly is the last token sensor assembly that is connected.

Input Select B—The selection of Mode 1 or 2. If the token sensor assembly is connected to another token sensor assembly then the line input select B will become input select A in the next token sensor assembly.

Data In B—Feedback to the token sensor controller. Connected if loopback switch is closed, which occurs if loopback ctrl B is at 0 V.

Dim Ctrl B—Controls the brightness of the light sources. If the token sensor assembly is connected to another token sensor assembly then the line Dim Ctrl B will become Dim Ctrl A in the next token sensor assembly.

Referring to FIG. 7E, the token sensor assembly 130 (FIG. 1) may further include drivers 428, additional time-constant resistor capacitors 424 may be configured to flatten the spike output from the surge suppressor 426 in the event of a power surge. As a result, the circuit may avoid the use of cumbersome ground plate for suppression of voltage (26 kV) spikes. The surge suppressor 426 is connected to drivers 428, general connecting wires, and to Earth ground through a grounding strap, which is electrically connected to the Earth ground wire, which is electrically connected to the third prong of the electrical power plug. In addition, the token sensor assembly 130 may include a loopback switch 431 that switches if the token sensor assembly is the last token sensor assembly in the serial string of token sensor assemblies. FIG. 7E also shows the remaining portion of the power input circuit 422 introduced in FIG. 7B.

Figure 8:
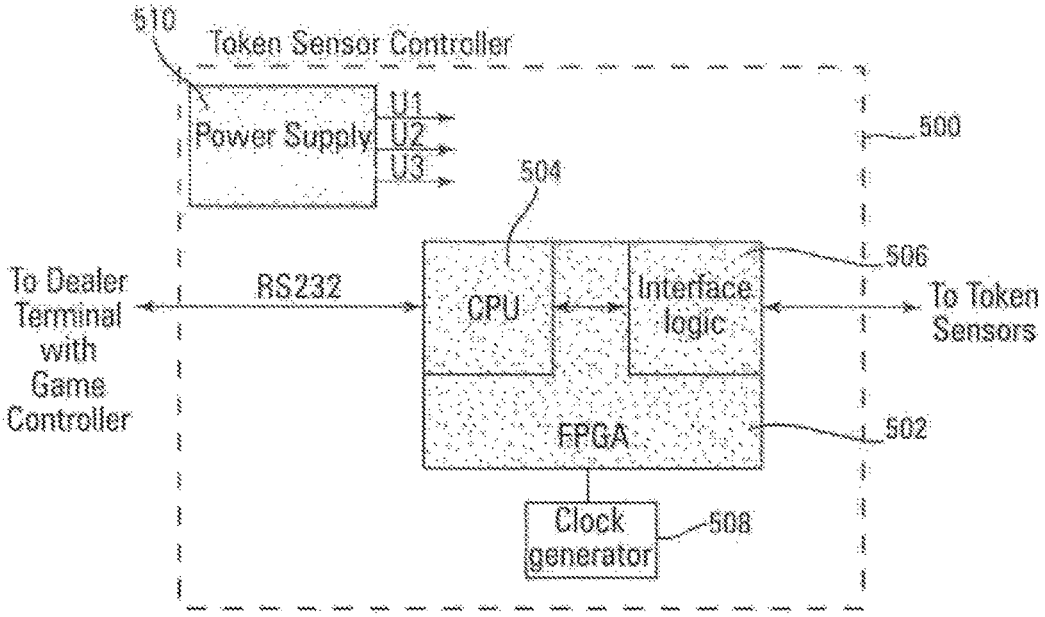
FIG. 8 is a block diagram of an exemplary token sensor controller.

FIG. 8 is a block diagram of an exemplary token sensor controller 500 (e.g., token sensor controller 160 in FIG. 1). The token sensor controller 500 may include a power supply 510, a processor such as an FPGA 502, and a clock generator 508. The FPGA 502 may contain the following components: a CPU 504, interface logic 506 and associated wiring or contacts to connect with other components operatively connected to the FPGA 502. The CPU 504 is a central processing unit that carries out each instruction of a computer program in sequence, to perform the basic arithmetical, logical, and input/output operations of the FPGA 502. The interface logic 506 is a circuit with logic gates to transfer information between the token sensor assemblies 130 and the CPU 504.

The clock generator 508 is operatively connected to the FPGA 502. The clock generator 508 is a circuit that produces a timing signal (known as a clock signal and behaves as such) for use in synchronizing the operation of the token sensors (the Data Clk A line described above). The clock signal is generally a simple symmetrical square wave. The power supply 510 provides power to the token sensor controller 500. The connection between the FPGA 502 and the dealer input and display 150 (FIG. 1) uses an RS 232 standard for serial port communication with a custom computer protocol.

The token sensor controller 160 (FIG. 1) may be configured to perform different functions that impact the operation of token sensor assemblies 130. These functions may be performed one at a time. The token sensor controller 160 may read or change the state of a memory 416 (FIG. 7D) of each token sensor assembly 130. The state of the memory 416 of each token sensor assembly 130 can be ON or OFF. The token sensor controller 160 may force the state of the memory 416 to be copied into the state of the light sources 320 (FIG. 4). The token sensor controller 160 may also force the state of the token sensor 340 (FIG. 4) into the memory 416.

The token sensor controller 160 (FIG. 1) may read the state of the token sensor assemblies 130 (FIG. 3) by forcing all of the token sensor assemblies 130 to force the state of the token sensor 340 (FIG. 4) on to each token sensor assembly 130 into the memory 416 (FIG. 7D) at the same time. If there is a token 265 (FIG. 3) present at this time, the memory will be set to ON. Otherwise it is set to OFF. The token sensor controller 160 will then read all of the token sensor assemblies 130 by shifting the state of the memory 416 into the token sensor controller 160 one at a time.

The token sensor controller 160 (FIG. 1) can set the desired state of all of the token sensor assemblies 130 (FIG. 3). The desired state of each token sensor assembly 130 is shifted into the memory 416 (FIG. 7D) of each token sensor assembly 130, one at a time. The token sensor controller 160 will force all of the states of each memory 416 of each token sensor assembly 130 to be copied into the state of the light sources 320 (FIG. 4) at the same time. If the memory 416 is on the light sources 320 will be on; otherwise the light sources 320 will be off.

In addition, the token sensor controller 160 (e.g., through the FPGA 502) may be configured to control the token sensor assembly 130 (FIG. 3) to poll the token sensor 340 (FIG. 4) only when the light sources 320 (FIG. 4) are off. As a result, the interference and potential misreads may be reduced from the light emitted within the token sensor assembly 130—particularly for embodiments where the plurality of lights emit wavelengths that are within the region of the spectral response that will trigger the token sensor 340.

The token sensor controller 500 may also be connected to the game controller 170 (FIG. 1). The game controller 170 is a small personal computer that contains a dealer processor, which has a small single board computer and an I/O board with a sensor controller and door switch. An example of a single board computer which could be used is an D3883 family board from iBase Technology, Inc. The token sensor controller 500 drives two mechanical meters as well. The dealer input and display 150 has a capacitive touch screen display, which is made by Zytronic PLC. The game controller 170 is connected to a dual monitor panel (not shown), which is used to display the progressive values and other information regarding the game being played at the table. An example of such monitors would be two EFL 1903X from Effinet Systems, Inc., packaged as model number EFL 1903XD.

Each table's game controller 170 (FIG. 1) is connected to a computer server via Ethernet directly or via a serial link with an adapter to allow for Ethernet communication. The server runs a MICROSOFT® WINDOWS 2000® operating system or later version of an operating system based software program, which has the following desirable functions (amongst other functions):

1. A user interface to configure the progressive games on the link that includes the game type (i.e., CARIBBEAN STUD® poker, THREE CARD POKER PROGRESSIVE® game or PROGRESSIVE TEXAS HOLD'EM™ game) to be selected with pay table options along with the progressive meter start value, the amount incremented to the progressive meter from each wager, the reserve amount from each wager and the casino profit from each wager.
2. A tool to configure communication ports.
3. A tool monitor for progressive jackpot activity on the serial links.
4. A computer to generate reports on the system, user, wins (including W2G tax forms) and other useful table game information.

An example of such a software program is the GAME MANAGER™ software sold by SHFL entertainment, Inc.

When a top award in a pay table is won by a player (such as by a player attaining a royal flush in CARIBBEAN STUD® poker) and the player's token sensor assembly is lit, the dealer (and casino supervisory personnel as well) enter that information on the touch screen input at the dealer input and display 150 (FIG. 1). The player's cards are visually compared to the required top award by the appropriate casino personnel. The player's hand can also be verified by an i-DEAL® shuffler sold by Bally Gaming, Inc. This shuffler is described in detail in U.S. Patent Publication US2008/0303210. The content of this application is incorporated by reference. The i-DEAL® shuffler can also provide an input into the game controller of a top award win or a lower jackpot or bonus win. The game controller communicates the top award win to the server. The server then resets all of the progressive meters on the link to a start value or to a reduced value when a lower award was made that was taken from the progressive jackpot amount. The progressive jackpot amount increments until a player wins and either causes the meter to reset to a start value (usually a top award win like a royal flush in CARIBBEAN STUD®) or the progressive amount is reduced by certain wins (i.e., 10% of the meter would be paid if a player received a straight flush in CARIBBEAN STUD®), which are paid out of the progressive jackpot amount.

Figure 10:
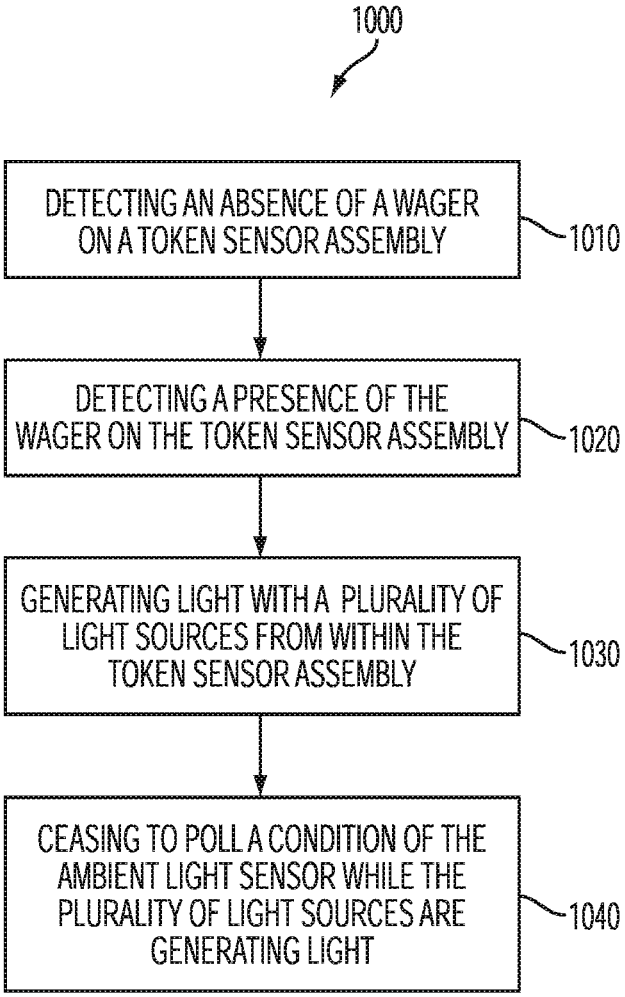
FIG. 10 is a flowchart illustrating a method of controlling a token sensor assembly according to an embodiment of the disclosure.

FIG. 10 is a flowchart 1000 illustrating a method of controlling a token sensor assembly according to an embodiment of the disclosure. At operation 1010, the method comprises detecting an absence of a wager on a token sensor assembly. Absence of the wager may be detected if ambient light passing through a translucent cover of the token sensor assembly is sensed by a passive ambient light sensor. As discussed above, both the translucent cover and the token sensor may have predetermined wavelength ranges that at least partially overlap to provide the token sensor with sufficient light for detection. The wavelength range for the translucent cover corresponds to the wavelengths chosen for passing certain wavelengths near that a peak wavelength, while filtering out other wavelengths from entering the token sensor assembly. The wavelength range for the token sensor corresponds to the spectral response of the token sensor for wavelengths to which the token sensor has been tuned.

At operation 1020, the method comprises detecting a presence of the wager on the token sensor assembly. The wager may detected if ambient light is blocked and not sensed by the passive ambient light sensor.

At operation 1030, the method comprises generating light with a plurality of light sources from within the token sensor assembly if the presence of the wager is detected. The light generated passes through the translucent cover to the players and/or dealer to indicate that a wager was made. The light generated may include flashing light initially when the wager is placed or continuous light when the wager is locked by the dealer. Other patterns are also contemplated, particularly for situations during game play when the player wins the game or side wager.

At operation 1040, the method comprises ceasing to poll a condition of the ambient light sensor while the plurality of light sources are generating light. To avoid interferences and misreads caused by the light emitted within the token sensor assembly, the condition of the ambient light sensor may be polled only when the light sources are not generating light. In some embodiments, the output from the token sensor may be ignored, disabled, or otherwise not used to determine whether a wager has been made.

Although specific ranges, specific compositions, and specific components have been identified to enable preferred practice of the present technology, one skilled in the art, reading the specification and viewing the figures, understands the generic concepts disclosed herein. This understanding enables the use of alternatives and options and design changes within the skill of the ordinary artisan in the electronics and imaging field, without undue experimentation and within the scope of the claims.

What is claimed is:

1. A token sensor assembly for detecting presence of a token in variable light conditions, comprising:

a container having side walls that define an inside perimeter and an outside perimeter between a top end and a bottom end of the container;

a translucent cover coupled to the top end of the container, the translucent cover configured to pass wavelengths of a predetermined range within a visible spectrum for transmission through the translucent cover;

a passive ambient light sensor disposed on a circuit board within the container, the passive ambient light sensor configured to:

operate in a high gain mode within the variable light conditions having a light range of 11 lumens per square meter (lux) to at least 400 lux;

generate a signal responsive to detecting an absence of light entering the container when a token is placed on the translucent cover; and transmit the signal indicative of placement of the token on the translucent cover to a game controller; and a plurality of light sources operably coupled with the passive ambient light sensor, the plurality of light sources configured to provide a visual indication of a wager responsive to the signal, wherein the token sensor assembly is configured to poll a condition of the passive ambient light sensor if the plurality of light sources is off and not poll the condition of the passive ambient light sensor if the plurality of light sources is on.

2. The token sensor assembly of claim 1, wherein the translucent cover is configured to be detachably coupled to the top end of the container.

3. The token sensor assembly of claim 1, wherein the predetermined range is selected from the group consisting of 380 nm to 450 nm, 450 nm to 495 nm, 495 nm to 570 nm, 570 nm to 590 nm, 590 nm to 620 nm, and 620 nm to 750 nm.

4. The token sensor assembly of claim 1, wherein the predetermined range overlaps with a spectral response of the passive ambient light sensor.

5. The token sensor assembly of claim 4, wherein the spectral response of the passive ambient light sensor includes a sensitivity ratio of at least 0.8 for wavelengths within the predetermined range.

6. The token sensor assembly of claim 1, wherein the plurality of light sources is configured to flash on and off according to a predetermined pattern until wagers are locked responsive to a dealer input.

7. The token sensor assembly of claim 1, wherein the plurality of light sources is located within the container.

8. The token sensor assembly of claim 7, further comprising a diffuser positioned above the plurality of lights and below the translucent cover.

9. The token sensor assembly of claim 1, wherein the light range is from 11 lux to at least 1000 lux.

10. A token sensor apparatus, comprising:

a first token sensor assembly, including:

a container including container side walls that define an inside perimeter and an outside perimeter of the container;

a translucent cover disposed on a top surface of the side walls;

a passive ambient light sensor disposed within the container, and configured to operate in a high gain mode that triggers the passive ambient light sensor detecting light over a variable range of light having 11 lux to at least 400 lux;

an operational amplifier operably coupled with the passive ambient light sensor, and configured to saturate responsive to the passive ambient light sensor detecting the light within the variable range;

a light controller coupled to the passive ambient light sensor; and a visual element operably coupled to the light controller, the visual element configured to flash responsive to a control signal received from the light controller indicative of when a token has been placed on the translucent cover to block ambient light from the passive ambient light sensor, and wherein the light controller is configured to not poll a condition of the passive ambient light sensor while the visual element is illuminating.

11. A token sensor apparatus, comprising:

a first token sensor assembly, including:

a container including container side walls that define an inside perimeter and an outside perimeter of the container;

a translucent cover disposed on a top surface of the side walls;

a passive ambient light sensor disposed within the container, and configured to operate in a high gain mode that triggers the passive ambient light sensor detecting light over a variable range of light of 11 lux to at least 400 lux; and an operational amplifier operably coupled with the passive ambient light sensor, and configured to saturate responsive to the passive ambient light sensor detecting the light within the variable range, wherein the high gain mode has a gain of at least 100×;

a light controller operably coupled to the passive ambient light sensor; and a visual element including light sources operably coupled to the light controller and configured to indicate when a token has been placed on the translucent cover to block ambient light from the passive ambient light sensor by flashing responsive to a control signal received from the light controller, wherein the light controller is configured to not poll a condition of the passive ambient light sensor while the light sources are illuminating.

12. The token sensor apparatus of claim 10, wherein the light controller is configured to not poll the condition of the passive ambient light sensor by ignoring a signal generated by the passive ambient light sensor while the visual element is illuminating.

13. The token sensor apparatus of claim 10, wherein the light controller includes control logic configured to ignore the control signal responsive to the light controller receiving feedback that the light was detected while the visual element is illuminating.

14. A method of controlling a token sensor assembly, the method comprising:

operating a passive ambient light sensor in a high gain mode over variable ambient light conditions between 11 lux and at least 400 lux;

detecting ambient light within a subset of a visible light spectrum passing through a translucent cover of the token sensor assembly indicative of absence of a token being positioned on the translucent cover for the token sensor assembly;

detecting absence of the ambient light indicative of the token being positioned on the translucent cover for the token sensor assembly;

transmitting a signal to at least one of a game controller or a light controller indicating whether the token is positioned on the translucent cover;

generating light with a plurality of light sources from within the token sensor assembly, the generated light passing through the translucent cover and out from the token sensor assembly if a presence of a wager is detected; and ceasing to poll a condition of the passive ambient light sensor while the plurality of light sources is generating the light.

15. The method of claim 14, wherein ceasing to poll the condition of the passive ambient light sensor includes ignoring the signal generated by the passive ambient light sensor while the plurality of light sources is generating the light.

16. The method of claim 14, wherein ceasing to poll the condition of the passive ambient light sensor includes ignoring the signal responsive to the light controller receiving feedback that the light was detected while the light sources are illuminating.

17. The method of claim 14, further comprising alternating between polling and not polling the condition while the plurality of lights sources is flashing.

* * * * *